US007635826B2

(12) United States Patent
Yamada et al.

(10) Patent No.: US 7,635,826 B2
(45) Date of Patent: Dec. 22, 2009

(54) GLOW PLUG HAVING BUILT-IN SENSOR

(75) Inventors: Yuichi Yamada, Kohnan (JP); Shunsuke Maeda, Komaki (JP); Tatsuki Hirabayashi, Nagoya (JP); Akito Ishihara, Tsushima (JP); Tatsunori Yamada, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 386 days.

(21) Appl. No.: 11/811,971

(22) Filed: Jun. 13, 2007

(65) Prior Publication Data

US 2007/0295710 A1 Dec. 27, 2007

(30) Foreign Application Priority Data

Jun. 14, 2006 (JP) ..... 2006-165203
May 11, 2007 (JP) ..... 2007-127223

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/260, 261, 262, 263, 264, 266, 267, 268, 219/269

See application file for complete search history.

(56) References Cited

U.S. PATENT DOCUMENTS

| | | | | |
|---|---|---|---|---|
| 6,335,516 | B1 * | 1/2002 | Muller et al. | 219/270 |
| 6,416,848 | B2 * | 7/2002 | Sawamura | 428/209 |
| 6,979,801 | B2 * | 12/2005 | Okazaki et al. | 219/270 |
| 2005/0252903 | A1 * | 11/2005 | Maki et al. | 219/270 |

FOREIGN PATENT DOCUMENTS

| | | |
|---|---|---|
| JP | 10122144 | 5/1998 |
| JP | 2005-90954 | 4/2005 |
| JP | 2005-207730 | 8/2005 |

* cited by examiner

*Primary Examiner*—Daniel L Robinson
(74) *Attorney, Agent, or Firm*—Kusner & Jaffe

(57) ABSTRACT

A glow plug includes a heater member; heater power lead wires which extend rearward along an axis and whose conductors electrically communicate with one and of a heater conductor for supply of power; a sensor, portion for detecting the combustion pressure of an internal combustion engine; a sensor connection line connected to the sensor portion and extending rearward along the axis; a housing; a sensor-portion-enclosing tube; and a grommet formed from an insulating rubber-like elastic material, having insertion holes through which the heater power lead wires and the sensor connection line are respectively inserted, the grommet liquid-tightly closing an end portion of the sensor-portion-enclosing tube and liquid-tightly holding the heater power lead wires and the sensor connection line.

6 Claims, 10 Drawing Sheets

GLOW PLUG HAVING BUILT-IN SENSOR

FIELD OF THE INVENTION

The present invention relates to a glow plug having a built-in sensor.

BACKGROUND OF THE INVENTION

Conventionally known glow plugs used to assist the start of an internal combustion engine include a glow plug having a built-in sensor, which is a combustion pressure sensor for detecting the combustion pressure of an internal combustion engine (refer to Japanese Patent Application Laid-Open (kokai) No. 2005-90954); a sensor for detecting the temperature of a heater of the glow plug; a sensor for detecting ion current (refer to Japanese Patent Application Laid-Open (kokai) No. 10-122114); a sensor for detecting combustion light; or a like sensor.

Meanwhile, a glow plug having a built-in sensor of a certain kind requires not only a lead wire for energizing a heater of the glow plug but also a single or a plurality of sensor connection lines for transmitting an output signal from the sensor and driving the sensor. Such a glow plug having a built-in sensor may be configured such that the sensor connection line(s) and the heater-energizing lead wire extend rearward from the rear end of the glow plug (from an end axially opposite the heater located at the front end of the glow plug).

Furthermore, for protection against entry of moisture and oil droplets from the outside, the glow plug may require liquid-tight sealing of its rear end by use of a grommet which is formed from rubber-like elastic material and which allows the heater-energizing lead wire and the sensor connection line(s) to extend through respective insertion holes formed in the grommet.

In some cases, a glow plug having a built-in sensor may require connection to an external power supply unit via a heater-energizing lead wire. This heater-energizing lead wire may be relatively large in the cross-sectional area of its conductor and thus have a large outside diameter as measured to include its coating layer. For example, a glow plug having a built-in sensor may require quick raising of temperature; for example, may require raising of its temperature to about 1,000° C. in 2 or 3 seconds. In order to externally apply a large current to a heater conductor, such a glow plug uses a heater-energizing lead wire which is relatively large in the cross-sectional area of its conductor and has a large outside diameter as measured to include its coating layer. As for a sensor connection line, in many cases, a sensor connection line having a relatively small outside diameter will suffice, since what is required of the sensor connection line is to transmit an output of a sensor and to supply a small power for driving the sensor.

However, in a glow plug having a built-in sensor configured such that a sensor connection line(s) and a heater-energizing lead wire extend rearward from the rear end of the glow plug (from an end axially opposite a heater located at the front end of the glow plug) and having a grommet that is used to establish liquid-tight seal, if the heater-energizing lead wire is large in the cross-sectional area of its conductor and thus has a large outside diameter as measured to include its coating layer, the outside diameter of the grommet must be increased in order to maintain liquid tightness. As a result, the outside diameter of the glow plug must also be increased. Meanwhile, because of demand for reduction in size and weight of an internal combustion engine, a reduction in diameter of a glow plug has been demanded. Therefore, increasing outside diameter is difficult for a glow plug and a grommet.

That is, for a glow plug having a built-in sensor configured such that a sensor connection line(s) and a heater-energizing lead wire extend rearward from the rear end of the glow plug and such that a grommet is used to establish liquid-tight seal, it is difficult to maintain or reduce the diameter of the glow plug while the cross-sectional area of a conductor of the heater-energizing lead wire is increased.

SUMMARY OF THE INVENTION

The present invention overcomes the above problems, and provides a glow plug having a built-in sensor which is configured such that a sensor connection line(s) and a heater-energizing lead wire extend rearward from the rear end of the glow plug and such that a grommet is used to establish liquid-tight seal and which allows a reduction in diameter of the glow plug while the cross-sectional area of a conductor of the heater-energizing lead wire is increased.

The present invention provides a glow plug which includes a built-in sensor and is adapted to be attached to an internal combustion engine, comprising a heater member having a heater conductor which generates heat upon energization, said heater member disposed at an axially front end of the glow plug along an axis of the glow plug; a plurality of heater power lead wires each having a conductor and a coating layer which covers the conductor and is formed from an insulating resin, and extending axially rearward, the conductors electrically communicating with one end of the heater conductor so as to supply power to the heater conductor; a sensor portion which outputs predetermined information concerning the internal combustion engine or the glow plug; at least a single sensor connection line covered with an insulating resin, connected directly or indirectly to the sensor portion, and extending rearward from the sensor portion along the axis; an enclosing member circumferentially enclosing a rear end portion of the heater member, front-end portions of the heater power lead wires, at least a portion of the sensor portion, and a front-end portion of the sensor connection line; and a grommet formed from an insulating rubber like elastic material, having a plurality of insertion holes which extend axially and through which the heater power lead wires and the sensor connection line are respectively inserted, liquid-tightly closing a rear end portion of the enclosing member, and liquid-tightly holding the heater power lead wires and the sensor connection line.

The glow plug of the present invention has the sensor portion in addition to the heater member which has the heater conductor for generating heat for the purpose of assisting the start of the internal combustion engine. The glow plug has the plurality of heater power lead wires for supplying power to the heater conductor, in addition to the sensor connection line connected directly or indirectly to the sensor portion. The heater power lead wires and the sensor connection line extend axially rearward through the insertion holes formed in the grommet.

In the glow plug, by virtue of the above configuration, the sensor connection line connected to the sensor portion allows a sensor output from the sensor portion to be transmitted therethrough and a required drive power to be supplied to the sensor portion therethrough. Furthermore, power can be supplied to the heater member (heater conductor) through the heater power lead wires. Since a plurality of the heater power lead wires are provided, current (power) to be applied to the heater member can be divided into those which flow through the respective heater power lead wires, thereby reducing current (power) which flows through each of the heater power lead wires. Thus, each of the heater power lead wires can be reduced in the cross-sectional area of its conductor and in outside diameter as measured to include its coating layer.

Although the glow plug of the present invention uses a plurality of heater power lead wires, in comparison with the case of using a single heater power lead wire having a relatively large diameter, the insertion holes formed in the grommet for allowing the respective heater power lead wires to be inserted therethrough can be reduced in diameter. Accordingly, liquid tightness can be maintained between the grommet and the inserted heater power lead wires, and the outside diameter of the grommet can be maintained or reduced. Therefore, the glow plug of the present invention can be protected against entry of liquid such as water or oil into the interior thereof between the enclosing member and the grommet or between the grommet and the heater power lead wires or between the grommet and the sensor connection line. Furthermore, since the heater power lead wires and the sensor connection line are coated, even when water or the like splashes on a rear end portion of the glow plug, no electrical communication is established between the enclosing member, the heater power lead wires, and the sensor connection line.

Preferably, the glow plug of the present invention is applied to a so-called quick temperature rise type in which the temperature of the heater member is raised to about 1,000° C. quickly; for example, in 2 or 3 seconds.

In order to hold appropriately and in a liquid-tight condition the heater power lead wires and the sensor connection line which are inserted through the grommet, the insertion holes formed in the grommet are arranged preferably in circumferentially equal intervals around the axis of the grommet (axis of the glow plug). This preferred arrangement includes a case where a single insertion hole is formed such that its axis coincides with the axis of the grommet, whereas the remaining insertion holes are arranged in circumferentially equal intervals around the axis of the grommet. Preferably, the insertion holes which are formed for the heater power lead wires and the sensor connection line and arranged in circumferentially equal intervals around the axis of the grommet have the same diameter. That is, the heater power lead wires and the sensor connection line have the same outside diameter.

No particular limitation is imposed on the heater member so long as the heater member has a heater conductor which generates heat upon energization. For example, the heater member may be such that a heater conductor formed from a metal or a conductive ceramic is embedded in an insulating ceramic. Alternatively, a heater conductor in the form of a metal member may serve as the heater member.

No particular limitation is imposed on the connection between the heater power lead wires and the heater conductor so long as the conductors of the heater power lead wires electrically communicate with one end of the heater conductor. For example, the conductors of the electric power lead wires may be connected mechanically and directly to one end of the heater conductor, thereby establishing electrical communication therebetween. Alternatively, the conductors of the electric power lead wires may be connected indirectly to one end of the heater conductor via an axial rod and another member, thereby establishing electrical communication therebetween.

Furthermore, no particular limitation is imposed on the sensor portion so long as the sensor portion can output predetermined information concerning the internal combustion engine or the glow plug. Examples of such a sensor portion include a combustion-pressure sensor portion which can detect variation of combustion pressure of the internal combustion engine by use of a piezoelectric element, a strain gauge, a piezoresistive element, or the like; a heater-temperature sensor portion which measures heater temperature by use of a temperature sensor such as a thermocouple; an ion-current-type combustion-condition sensor portion which detects the condition of combustion through application of iron current to the interior of a combustion chamber; and a combustion-light sensor portion which observes the light of combustion.

The sensor connection line is connected directly or indirectly to the sensor portion. Examples of such a sensor connection line include electric wires for transmitting an electric signal and power, such as an electric wire for transmitting an electric signal output from the sensor portion to an external device, an electric wire for supplying a drive power to the sensor portion, and an electric wire for externally transmitting a control signal to the sensor portion for controlling the sensor portion, as well as an optical fiber formed from glass and resin and adapted to transmit the light of combustion received by a combustion-light sensor to an external device or to transmit an optical communication control signal form or an optical output signal to an external device.

A rear end portion of the enclosing member is closed by means of the grommet such that a portion of the enclosing member which is located radially outward of the grommet is crimped so as to reduce the diameter of the portion, whereby the grommet is fixedly attached to and closes the rear end portion of the enclosing member.

Preferably, in the glow plug of the present invention, the enclosing member has a tool engagement portion whose outer shape is of a hexagonal prism, and a rear portion which is located rearward of the tool engagement portion and which includes the rear end portion. The rear portion assumes such a form as to be encompassed within an engagement-portion-projected region which results from axially rearward projection of the tool engagement portion.

In the glow plug of the present invention, the enclosing member has the tool engagement portion and the rear portion, which is located rearward of the tool engagement portion and assumes such a form as to be encompassed within the engagement-portion-projected region. This allows engagement of a tool with the tool engagement portion by fitting the tool to the tool engagement portion from an axially rearward direction in such a manner as to enclose the rear portion and the tool engagement portion of the enclosing member. Then, by rotating the tool, the glow plug can be attached to or detached from the internal combustion engine.

Furthermore, in this glow plug, the outline of the rear portion of the enclosing member imposes limitations on the arrangement of the heater power lead wires and the sensor connection line and on the outline of the grommet. Also, the shape of the rear portion of the enclosing member is limited to a shape which is encompassed within the engagement-portion-projected region. Therefore, the outside diameter of the grommet must be reduced, and the heater power lead wires and the sensor connection line must be compactly arranged.

As mentioned previously, the glow plug of the present invention employs a plurality of heater power lead wires. Therefore, while the grommet has a small outside diameter, the heater power lead wires and the sensor connection line can appropriately extend rearward through the grommet.

The expression "the rear portion assumes such a form as to be encompassed within an engagement-portion-projected region" means that, for example, when the rear portion assumes a cylindrical outline, the diameter of the rear portion is equal to or smaller than the opposite-side distance of the tool engagement portion having a shape of a hexagonal prism.

Preferably, in the above-mentioned glow plug of the present invention, the total cross-sectional area of the conductors of the heater power lead wires is 1.0 $mm^2$ or greater, and the outside diameter of each of the heater power lead wires is 20% or less of the minimum outside diameter of a portion of the grommet in a condition of holding the heater power lead wires, which portion of the grommet is in liquid-tightly close contact with the enclosing member.

In the case of a glow plug to which a large current must be applied; for example, a glow plug of a quick temperature rise type, in order to avoid an increase in temperature of a heater power lead wire through reduction in its resistance, the cross-sectional area of a conductor of the heater power lead wire must be increased. In order to attain a large cross-sectional area of a conductor of 1.0 $mm^2$ or greater by use of a single heater power lead wire, the diameter of the conductor of the heater power lead wire exceeds 1.125 mm. As a result, the heater power lead wire has a large outside diameter of greater than 2.1 mm as measured to include its coating layer.

In the case where the outside diameter of the grommet is not changed, when this thick heater power lead wire and the sensor connection line are inserted through the grommet, the interval between the heater power lead wire and the sensor connection line or the distance between the outer circumferential surface of the grommet and the heater power lead wire or the sensor connection line becomes short. This may deteriorate liquid tightness between the enclosing member and the grommet or liquid tightness between the grommet and the heater power lead wire or the sensor connection line. Thus, there may have no other alternative but to increase the outside diameter of the grommet.

By contrast, in the glow plug of the present invention, while the total cross-sectional area of the conductors of the heater power lead wires is as large as 1.0 $mm^2$ or greater, the outside diameter of each of the heater power lead wires is as small as 20% or less of the outside diameter of the grommet in a condition of holding the heater power lead wires. Accordingly, a large current can be applied to the heater conductor through the plurality of heater power lead wires, and the grommet can have a small outside diameter while maintaining appropriate liquid tightness.

Preferably, in the above-mentioned glow plug of the present invention, the sensor portion serves as a combustion-pressure sensor portion for measuring the combustion pressure of the internal combustion engine by use of a piezoelectric element or a piezoresistive element.

The glow plug of the present invention has the combustion-pressure sensor portion; i.e., the glow pug has piezoelectric elements or a piezoresistive element. Thus, entry of water, oil, or the like into the combustion-pressure sensor portion may deteriorate the insulating performance and other characteristics of these elements.

However, in the glow plug of the present invention, as mentioned previously, the grommet liquid-tightly closes a rear end portion of the enclosing member, thereby reliably preventing the above drawback and enabling appropriate detection of a combustion pressure.

The above-mentioned glow plug of the present invention further comprises an axial rod which is disposed frontward of the grommet within the enclosing member and extends along the axis and whose front-end portion is connected to the heater member in a mechanically rigid manner. In the glow plug, the combustion-pressure sensor portion is configured so as to detect variation of the combustion pressure by means of movement of the heater member.

In a glow plug which has an axial rod connected to a heater member in a mechanically rigid manner and a combustion-pressure sensor portion adapted to detect variation of combustion pressure by means of movement of the heater member and in which the axial rod projects rearward from the rear end of the glow plug, vibration of a lead wire connected to the axial rod or vibration of the axial rod induced by contact of the axial rod with another body is transmitted to the combustion-pressure sensor portion directly from the axial rod or indirectly via the heater member or the like, potentially resulting in superposition of noise on output of the sensor portion.

By contrast, although the glow plug of the present invention comprises an axial rod connected to the heater member in a mechanically rigid manner and is such that the combustion-pressure sensor portion is configured so as to detect variation of combustion pressure by means of movement of the heater member, the axial rod is disposed frontward of the grommet. That is, in the glow plug, the axial rod does not project rearward beyond the grommet.

Accordingly, the glow plug of the present invention is free from transmission of vibration to the combustion-pressure sensor portion through the axial rod extending rearward. Thus, superposition of noise on output from the combustion-pressure sensor portion is prevented, so that combustion pressure can be appropriately detected. Even when a heater power lead wire or the like vibrates, the grommet restrains transmission of vibration to a member (e.g., the axial rod to which the heater power lead wire is connected) disposed within the glow plug; therefore, no noise is superposed on the output.

Preferably, in the above-mentioned glow plug of the present invention, the sensor connection line has a conductor and a coating layer, which is formed from an insulating resin and covers the conductor, and connection terminals are used to crimp and hold respective front-end portions of the conductors of the heater power lead wires and the sensor connection line.

Direct welding, direct soldering, or the like is a conceivable method of connecting a front-end portion of the conductor of each heater power lead wire to one end of the heater conductor or to a member, such as an axial rod, which intervenes between the heater power lead wire and the heater conductor. Also, direct welding, direct soldering, or the like is a conceivable method of connecting a front-end portion of the conductor of the sensor connection line to a member of the sensor portion.

However, such a method may involve a deterioration in the reliability of connection; specifically, an electric disconnection caused by cracking in a connected portion (welded portion or soldered portion) which in turn is caused by subjection of the glow plug to vibration.

By contrast, in the glow plug of the present invention, the conductors are connected to the respective members via the respective connection terminals which are crimped to and hold the conductors, thereby preventing cracking or electrical disconnection and enhancing the reliability of connection.

The present invention further provides a glow plug which includes a built-in sensor and is adapted to be attached to an internal combustion engine, comprising a heater member having a heater conductor which generates heat upon energization, and disposed at an axially front end of the glow plug along an axis of the glow plug; an axial rod which extends along the axis and whose front-end portion is connected to the heater member in a mechanically rigid manner; a plurality of heater power lead wires each having a conductor and a coating layer which covers the conductor and is formed from an insulating resin, and extending axially rearward, the conductors electrically communicating with one end of the heater conductor so as to supply power to the heater conductor; a combustion-pressure sensor portion configured so as to detect variation of combustion pressure by means of movement of the heater member; an enclosing member circumferentially enclosing a rear end portion of the heater member, the axial rod, front-end portions of the heater power lead wires, and at least a portion of the combustion-pressure sensor portion; and a grommet formed from an insulating rubber-like elastic material, extending along the axis, allowing insertion of the heater power lead wires therethrough, liquid-tightly closing a rear end portion of the enclosing member, and liquid-tightly holding the heater power lead wires. In the glow plug, the axial rod is disposed frontward of the grommet.

As mentioned previously, in a glow plug which has an axial rod connected to a heater member in a mechanically rigid manner, and a combustion-pressure sensor portion adapted to detect variation of combustion pressure by means of movement of the heater member and in which the axial rod projects rearward from the rear end of the glow plug, vibration of a lead wire connected to the axial rod or vibration of the axial rod induced by contact of the axial rod with another body is transmitted to the combustion-pressure sensor portion directly from the axial rod or indirectly via the heater member or the like, potentially resulting in superposition of noise on output of the sensor portion.

By contrast, although the glow plug of the present invention includes the axial rod connected to the heater member in a mechanically rigid manner, and the combustion-pressure sensor portion configured so as to detect variation of combustion pressure by means of movement of the heater member, the axial rod is disposed frontward of the rear end of the grommet. That is, in the glow plug, the axial rod does not project rearward from the rear end of the glow plug. The grommet restrains transmission of vibration through the heater power lead wires, through which power is supplied to the heater conductor.

Accordingly, the glow plug of the present invention is free from such a drawback that accidental vibration which is externally transmitted to the axial rod is transmitted to the combustion-pressure sensor portion directly from the axial rod or indirectly via the heater member or the like. Thus, superposition of noise on output from the combustion-pressure sensor portion is prevented, so that combustion pressure can be appropriately detected.

DETAILED DESCRIPTION OF PREFERRED EMBODIMENTS

Embodiment 1

Figure 1:
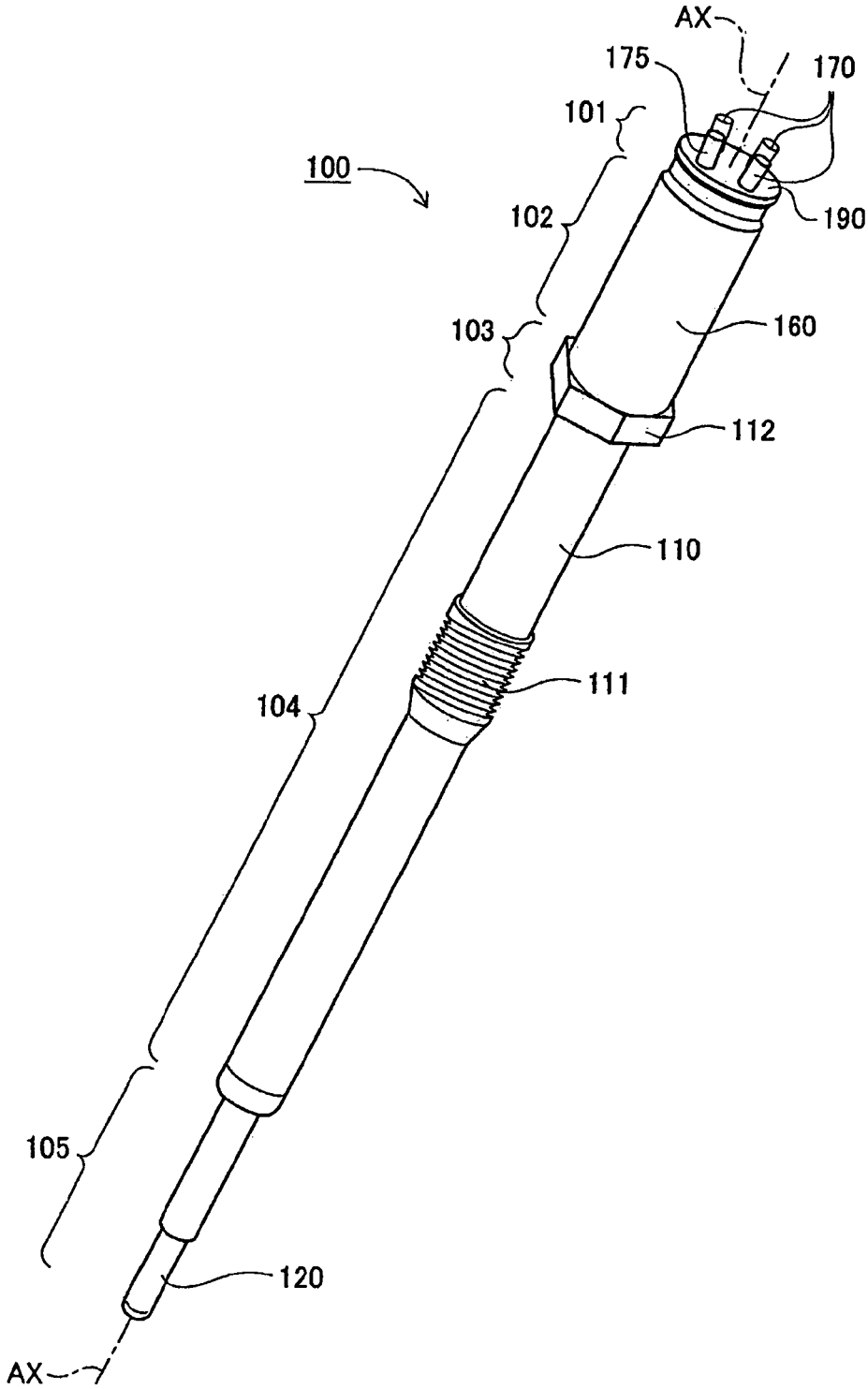
FIG. 1 is a perspective view showing a glow plug having a built-in combustion pressure sensor using piezoelectric elements according to Embodiment 1 of the present invention.

An embodiment of the present invention will be described with reference to FIGS. 1 to 5. FIG. 1 shows an external view of a glow plug having a built-in combustion pressure sensor (hereinafter, may be referred to merely as a glow plug) 100 according to Embodiment 1. The glow plug 100 can generate heat for assisting the start of an internal combustion engine through energization of a heater member 120 and has a sensor portion 140 configured so as to detect variation of combustion pressure of the internal combustion engine.

The glow plug 100 assumes a shaft-like form extending along an axis AX and includes, from a rear side (upper right side in FIG. 1) to a front side (lower left side in FIG. 1) along the axis AX, a plug rear-end section 101, a sensor-containing section 102, a hexagonal section 103, a plug intermediate-trunk section 104, and a plug front-end section 105.

The plug rear-end section 101 is located most rearward in the glow plug 100 and encompasses a grommet 190, which will be described later. Three heater power lead wires 170 and a sensor connection line 175, which will be described later, extend rearward from the plug rear-end section 101 (grommet 190). The sensor-containing section 102 contains a sensor portion 140. As will be described later, the sensor portion 140 includes pressure sensor elements (piezoelectric elements) which play a central role in detecting the combustion pressure of an internal combustion engine (not shown) to which the glow plug 100 is attached. The hexagonal section 103 assumes the form of a hexagonal prism and has a tool engagement portion 112 with which a tool is engaged when the glow plug 100 is screwed into a threaded hole of the internal combustion engine (not shown). The plug front-end section 105 is composed primarily of a heater member 120, which will be described later. The plug intermediate-trunk section 104 is located between the hexagonal section 103 and the plug front-end section 105 and assumes a generally cylindrical form. The plug intermediate-trunk section 104 has an externally threaded portion 111 having external threads, at its axially central portion.

Figure 2:
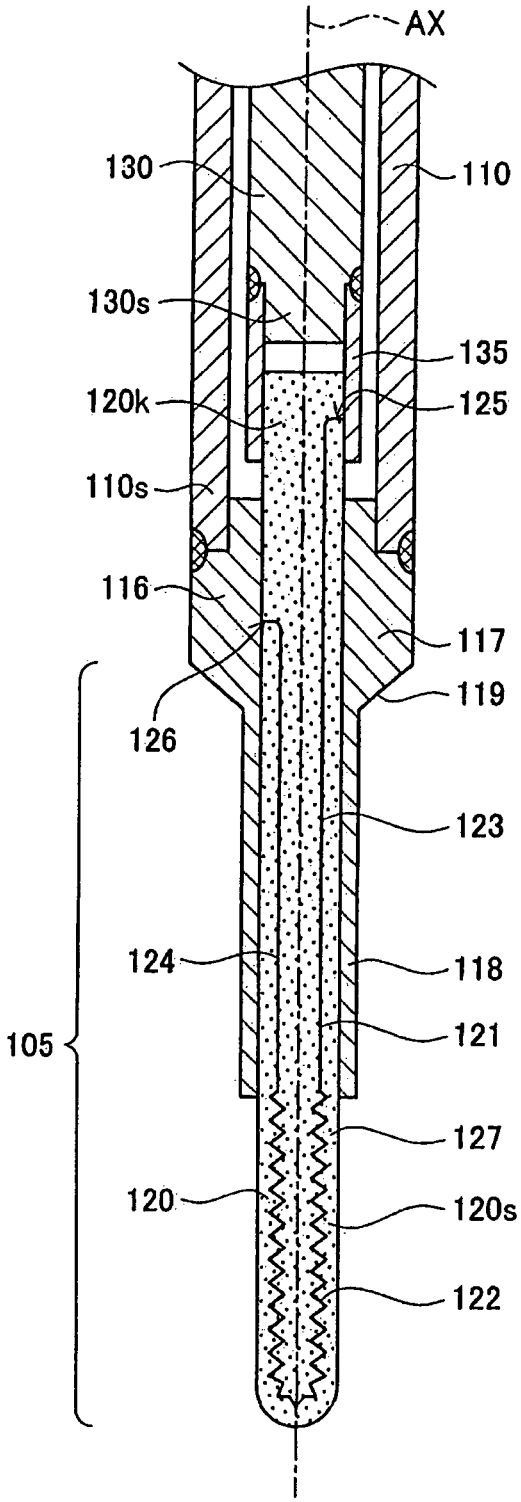
FIG. 2 is a partial, vertical sectional view showing the structure of a front-end portion of the glow plug having a built-in combustion pressure sensor according to Embodiment 1.

In the description of Embodiment 1 and the following Embodiment 2, a side toward the grommet 190 along the axis AX is referred to as a rear side, and a side toward the heater member 120 is referred to as a front side. Accordingly, in FIG. 1, the upper right side corresponds to the rear side, and the lower left side corresponds to the front side. In FIG. 2, etc., the upper side corresponds to the rear side, and the lower side corresponds to the front side.

As shown in FIG. 2, the glow plug 100 has a tubular housing 110 which extends along the axis AX (axial direction). The glow plug 100 further has an axial rod 130 which is held within the housing 110 and is electrically conductive. Rod-like heater member 120 is disposed frontward (downward in FIG. 2) of the axial rod 130 and is electrically connected to the axial rod 130 in a mechanically rigid manner by means of a connection ring 135. The heater member 120 is held by a heater-holding member 116 which is welded to a front-end portion 110*s* of the housing 110.

The heater-holding member 116 has a cylindrical rear-end large-diameter portion 117 which is substantially equal in diameter to the housing 110. A cylindrical front-end small-diameter portion 118 is located frontward of the rear-end large-diameter portion 117 and is smaller in diameter than the rear-end large-diameter portion 117. A taper seal surface 119 is located between the rear-end large-diameter portion 117 and the front-end small-diameter portion 118 and serves as a seal surface when the glow plug 100 is attached to an internal combustion engine.

Figure 3:
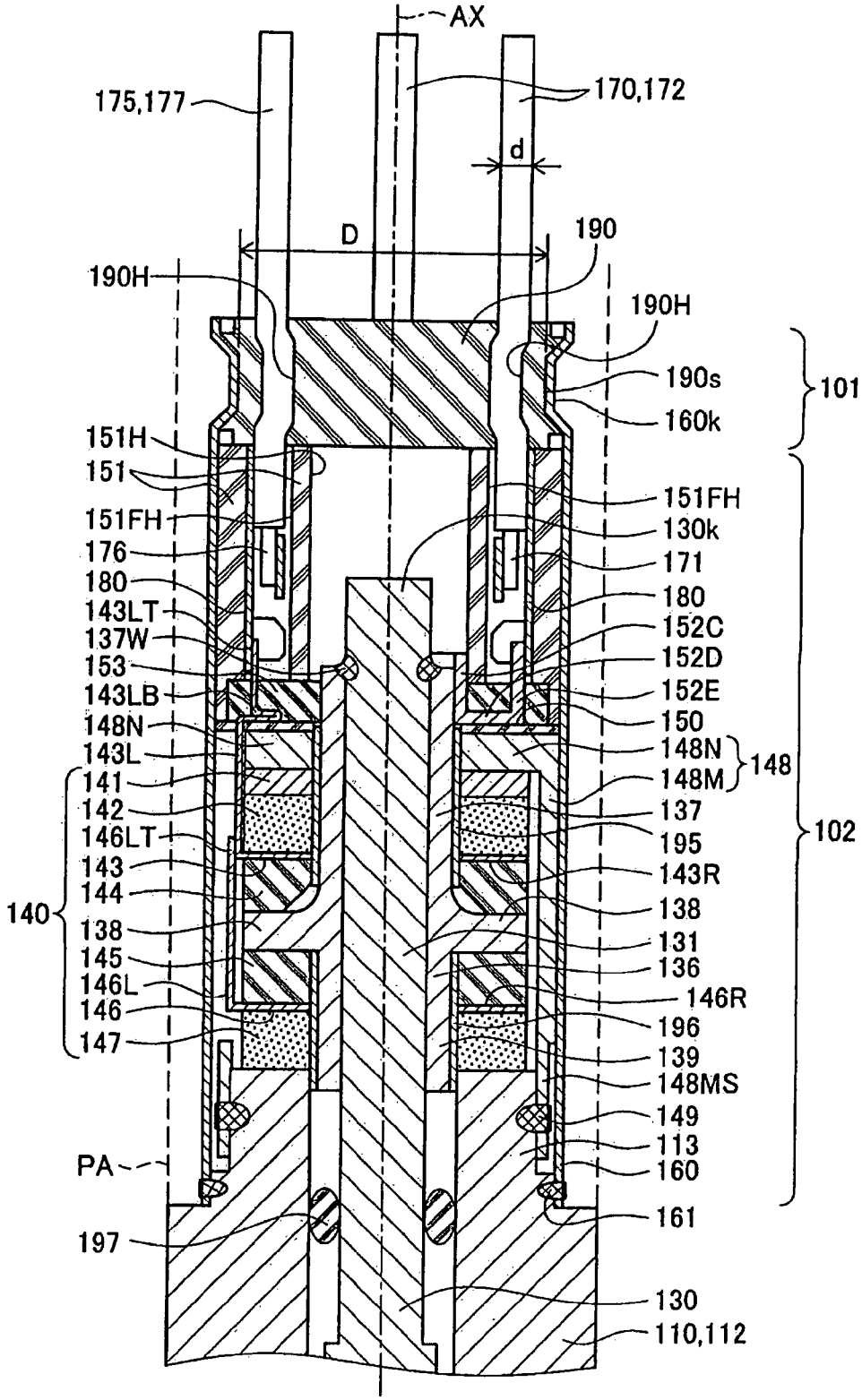
FIG. 3 is a partial, vertical sectional view showing the structure of a rear end portion of the glow plug having a built-in combustion pressure sensor according to Embodiment 1.

As shown in FIG. 3, the glow plug 100 has the sensor portion 140 which is contained within the sensor-containing section 102 located at its rear side. Sensor portion 140 can detect variation of combustion pressure of an internal combustion engine (not shown) to which the glow plug 100 is attached. The glow plug 100 further includes the sensor connection line 175 for transmitting an output from the sensor portion 140 to an external device, the three heater power lead wires 170 electrically connected to the axial rod 130, a sensor-portion-enclosing tube 160 for enclosing the sensor portion 140, etc.

In the glow plug 100, as shown in FIG. 2, the heater member 120 located in the front-end section 105 assumes a columnar form whose front end has a generally semispherical shape. The heater member 120 includes an insulating ceramic body 127 formed from a silicon-nitride ceramic. A heater conductor 121 is embedded in the insulating ceramic body 127 and is formed of a nonmetallic heat-generating element. In the glow plug 100, the heater member 120 is disposed such that its front-end portion 120*s* projects frontward from the front-end small-diameter portion 118 of the heater-holding member 116. The heater conductor 121 is formed into a shape resembling the letter U and has a heater heat-generating portion 122 which has high resistance and generates heat upon energization, and heater lead portions 123 and 124 which extend rearward from the heater heat-generating portion 122. The heater heat-generating portion 122 is disposed within the front-end portion 120*s* of the heater member 120.

End portions of the heater lead portions 123 and 124 are exposed at the outer circumferential surface of a rear end portion of the heater member 120 and serve as an axial-rod-side conductor end portion 125 and a ground-side conductor end portion 126, respectively. The axial-rod-side conductor end portion 125 is formed at a rear end portion 120*k* of the heater member 120. Since the rear end portion 120*k* is press-fitted into the tubular connection ring 135, the axial-rod-side conductor end portion 125 and the connection ring 135 are electrically connected to each other. The connection ring 135 is welded to a diameter-reduced front-end portion 130*s* of the axial rod 130. A portion of the heater member 120 which includes the ground-side conductor end portion 126 and is located rearward of the front-end portion 120*s* is press-fitted into the heater-holding member 116, whereby the ground-side conductor end portion 126 and the heater-holding member 116 electrically communicate with each other. When the glow plug 100 is attached to an internal combustion engine (not shown), the heater-holding member 116 electrically communicates with the internal combustion engine having the ground potential via the housing 110. As a result, the ground-side conductor end portion 126 is grounded. Thus, current can flow from the axial rod 130 to the internal combustion engine having the ground potential by way of the heater conductor 121 of the heater member 120. Therefore, the heater heat-generating portion 122 and the front-end portion 120*s* of the heater member 120, can generate heat. The axial rod 130 and the rear end portion 120*k* of the heater member 120 are connected together in a mechanically rigid manner via the connection ring 135. Accordingly, when the heater member 120 slightly moves rearward along the axial direction due to an increase in combustion pressure associated with driving of an internal combustion engine, the axial rod 130 also moves slightly rearward.

In the heater member 120, the heater heat-generating portion 122 of the heater conductor 121 has a lower resistance as compared with those of ordinary glow plugs. Accordingly, when a battery voltage of about 14 V is applied to the glow plug 100, a current of up to about 40 A flows through the heater heat-generating portion 122. As a result, the front-end portion 120*s* of the heater member 120 increases in temperature from the room temperature to about 1,000° C. in about 2 or 3 seconds after application of voltage. That is, the glow plug 100 of the present embodiment is a so-called quick-temperature-rise-type glow plug.

Next, a rear-end region of the glow plug 100 will be described. As shown in FIGS. 1 and 3, the housing 110 has the tool engagement portion 112 having a shape of a hexagonal prism, and a housing rear-end portion 113 which is smaller in diameter than the tool engagement portion 112. The housing rear-end portion 113 is enclosed by the cylindrical sensor-portion-enclosing tube 160, which extends rearward (upward in FIG. 3) from the tool engagement portion 112. The housing rear-end portion 113 and the sensor-portion-enclosing tube 160 are laser-welded together at a weld zone 161.

The diameter of the sensor-portion-enclosing tube 160 is smaller than the opposite-side distance of the tool engagement portion 112 of the housing 110. That is, the sensor-portion-enclosing tube 160 assumes such a form as to be encompassed within an engagement-portion-projected region PA which is indicated by the broken line in FIG. 3 and which results from rearward projection of the tool engagement portion 112 along the axis AX.

When the glow plug 100 is to be attached to or detached from an internal combustion engine (not shown), the above feature allows a tool such as a wrench (not shown) to be engaged with the tool engagement portion 112 by fitting the tool to the tool engagement portion 112 from an axially rearward direction of the glow plug 100 in such a manner as to enclose the plug rear-end section 101, the sensor-containing section 102, and the hexagonal section 103 (tool engagement portion 112). Then, the glow plug 100 can be rotated with the tool.

The axial rod 130 is formed from iron and is disposed in the interior of the housing 110 and the sensor-portion-enclosing tube 160 and frontward of the grommet 190, which will be described later. As shown in FIG. 3, a tubular axial-rod sleeve 136 is fitted to a sensor insertion portion 131 of the axial rod 130, which sensor insertion portion 131 is located frontward (downward in FIG. 3) of a rear end portion 130*k* of the axial rod 130. The axial-rod sleeve 136 has a rear tubular-portion 137 which has a cylindrical shape and is located on the rear side, a front tubular-portion 139 which has a cylindrical shape is located on the front side of axial-rod sleeve 136. A flange-like outward projecting portion 138 is located between the rear tubular-portion 137 and the front tubular-portion 139 and projects radially outward (in the left-right direction in FIG. 3).

The axial-rod sleeve 136 is arc-welded (argon-welded) to the axial rod 130 at a weld zone 137W of a rear end of the rear tubular-portion 137. A front-end portion of the front tubular-portion 139 is inserted into the housing rear-end portion 113 of the housing 110. In the axial-rod sleeve 136, the rear tubular-portion 137 and the front tubular-portion 139 are enclosed by insulating tubes 195 and 196, respectively.

As shown in FIG. 3, an O-ring 197 is disposed at a predetermined position in a rear end portion of a space formed between the axial rod 130 and the housing 110. The O-ring 197 prevents entry of high-pressure gas coming from the front side into the sensor portion 140, thereby preventing corrosion and hindrance to detection of combustion pressure which could otherwise result from the entry of the high-pressure gas. The O-ring 197 is formed from heat-resistant fluorine-containing rubber.

Next, the sensor portion 140 will be described with reference to FIG. 3. The sensor portion 140 is configured rearward of the housing rear-end portion 113 and radially inward of the sensor-portion-enclosing tube 160. The sensor portion 140 has a laminated structure and includes, from the rear side (the upper side in FIG. 3), a pressing spacer 141; a first piezoelectric element 142; a first electrode sheet 143; a first insulating spacer 144; the outward projecting portion 138 of the axial-rod sleeve 136; a second insulating spacer 145; a second electrode sheet 146; and a second piezoelectric element 147. These elements are held in a compressed condition between the housing rear-end portion 113 located on the front side and an inward projecting portion 148N of a sensor cap 148 located on the rear side.

The sensor cap 148 is formed from an iron-nickel alloy; has a generally closed-bottomed tubular shape; and includes a tubular trunk portion 148M and the inward projecting portion 148N, which extends radially inward from a rear end portion of the trunk portion 148M. The trunk portion 148M and the inward projecting portion 148N of the sensor cap 140 are partially cut out (their left portions in FIG. 3 are cut out) so as to avoid interference with an electrode lead portion 143L of the first electrode sheet 143, which electrode lead portion 143L transmits, to the sensor connection line 175, outputs from the internally held first and second piezoelectric elements 142 and 147 of the sensor portion 140. A front-end portion of the trunk portion 148M of the sensor cap 148 is formed into a thin-wall portion 148MS which assumes a thin-walled annular form. The thin-wall portion 148MS and the housing rear-end portion 113 are laser-welded together at a weld zone 149.

The pressing spacer 141 of the sensor portion 140 is formed from an iron-nickel alloy and assumes a flat ring form through which the rear tubular-portion 137 of the axial-rod sleeve 136 is inserted.

The first piezoelectric element 142 is formed from a piezoelectric ceramic whose main component is lead zirconate titanate, and assumes a flat ring form through which the rear tubular-portion 137 of the axial-rod sleeve 136 is inserted. The first piezoelectric element 142 is polarized in the thickness direction and generates charges on its opposite sides upon subjection to a compressive stress or a tensile stress in the thickness direction.

Figure 5:
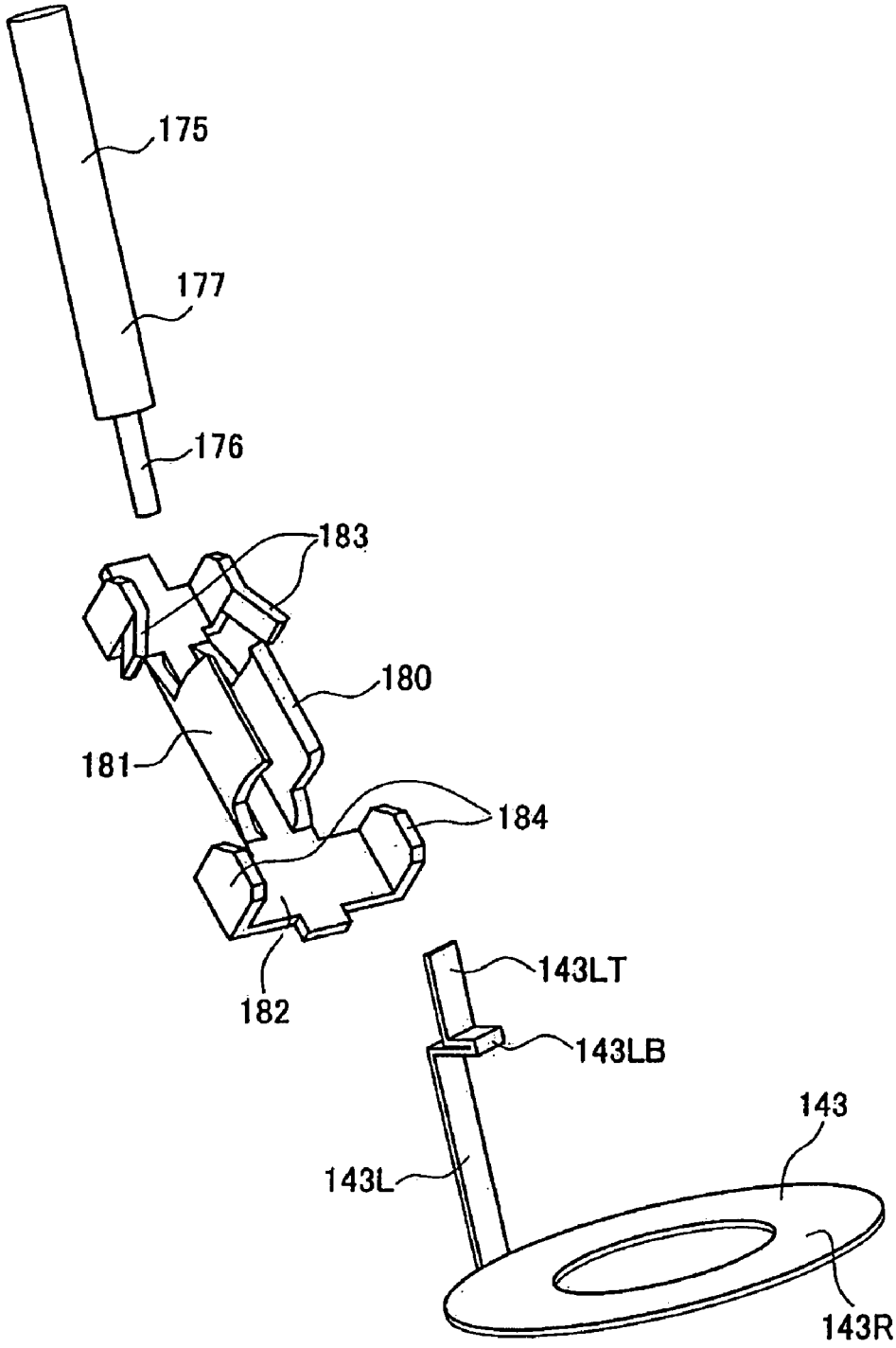
FIG. 5 is an explanatory view for explaining how a sensor connection line and a connection terminal are connected and how the connection terminal and an electrode sheet are connected.

The first electrode sheet 143 is formed from an iron-nickel alloy. As shown in FIG. 5, the first electrode sheet 143 has a ring portion 143R corresponding to a planar shape of the first piezoelectric element 142, and an electrode lead portion 143L which extends from an outer circumferential edge of the ring portion 143R in a direction (rearward) perpendicular to the ring portion 143R and which assumes a tape-like form having a predetermined width. The electrode lead portion 143L has a bend portion 143LB which is bent radially inward and outward at an intermediate portion of the electrode lead portion 143L and is then bent rearward. As will be described later, a rear end portion 143LT of the electrode lead portion 143L is welded to a connection terminal 180, thereby establishing electrical communication between the electrode lead portion 143 and the connection terminal 180.

The first insulating spacer 144 is disposed on the front side of the first electrode sheet 143. The first insulating spacer 144 is formed from alumina ceramic and assumes a flat ring form through which the rear tubular-portion 137 of the axial-rod sleeve 136 is inserted.

The outward projecting portion 138 of the axial-rod sleeve 136 is disposed on the front side of the first insulating spacer 144. Thus, when the combustion pressure of an internal combustion engine (not shown) increases, this pressure change causes the axial rod 130 to slightly move rearward relative to the housing rear-end portion 113 of the housing 110. As a result, a compressive stress applied to the first piezoelectric element 142 incrementally changes. This generates charges on the opposite sides of the first piezoelectric element 142. Charges generated on the rear side of the first piezoelectric element 142 flow to the housing 110 via the pressing spacer 141 in contact with the rear side of the first piezoelectric element 142, and the sensor cap 148. Charges generated on the front side of the first piezoelectric element 142 flow from the first electrode sheet 143 to an external device via the electrode lead portion 143L of the first electrode sheet 143, the connection terminal 180, and a conductor 176 of the sensor connection line 175.

The second insulating spacer 145 is disposed on the front side of the outward projecting portion 138 of the axial-rod sleeve 136 and assumes a flat ring form through which the front tubular-portion 139 of the axial-rod sleeve 136 is inserted.

The second electrode sheet 146 is disposed on the front side of the second insulating spacer 145 and is formed from an iron-nickel alloy. The second electrode sheet 146 has a ring portion 146R corresponding to a planar shape of the second piezoelectric element 147, and an electrode lead portion 146L which extends from an outer circumferential edge of the ring portion 146R in a direction (rearward) perpendicular to the ring portion 146R and which assumes a tape-like form having a predetermined width. A rear end portion 146LT of the electrode lead portion 146L is overlaid on and welded to the electrode lead portion 143L of the first electrode sheet 143, whereby the second electrode sheet 146 electrically communicates with the first electrode sheet 143. Accordingly, the second electrode sheet 146 also electrically communicates with the connection terminal 180 and the conductor 176 of the sensor connection line 175 via the electrode lead portion 143L of the first electrode sheet 143.

As in the case of the first piezoelectric element 142, the second piezoelectric element 147 is formed from a piezoelectric ceramic whose main component is lead zirconate titanate, and assumes a flat ring form through which the front tubular-portion 139 of the axial-rod sleeve 136 is inserted. The second piezoelectric element 147 is also polarized in the thickness direction and generates charges on its opposite sides upon subjection to a compressive stress or a tensile stress in the thickness direction.

The outward projecting portion 138 of the axial-rod sleeve 136 is disposed on the rear side of the second insulating spacer 145. Thus, when the combustion pressure of an internal combustion engine (not shown) increases, this pressure change causes the axial rod 130 to slightly move rearward relative to the housing rear-end portion 113 of the housing 110. As a result, a compressive stress applied to the second piezoelectric element 147 decrementally changes. This generates charges on the opposite sides of the second piezoelectric element 147. Charges generated on the front side of the second piezoelectric element 147 flow to the housing 110 via the housing rear-end portion 113 in contact with the front side of the second piezoelectric element 147. Charges generated on the rear side of the second piezoelectric element 147 flow from the second electrode sheet 146 to an external device via the electrode lead portion 143L of the first electrode sheet 143, the connection terminal 180, and the conductor 176 of the sensor connection line 175.

As mentioned above, charges which are generated in the two piezoelectric elements 142 and 147 in association with variation of combustion pressure are output via the sensor connection line 175, whereby the variation of combustion pressure can be detected.

Meanwhile, as shown in FIG. 3, the glow plug 100 has three heater power lead wires 170 which are connected to the axial rod 130 and adapted to energize the heater member 120 (heater conductor 121) via the axial rod 130, in addition to the sensor connection line 175 for transmitting outputs from the piezoelectric elements 142 and 147. A total of four lead wires 170 and 175 extend rearward from the interior of the sensor-portion-enclosing tube 160.

As shown in FIG. 5, the sensor connection line 175 is composed of the conductor 176 and a coating layer 177, which is formed from an insulating resin and covers the conductor 176. The sensor connection line 175 is fixed to the connection terminal 180 by crimping.

The connection terminal 180 is formed by press-blanking a metal sheet and bending the resultant blank. The connection terminal 180 has a crimp portion 181 which is formed at its substantially central portion and which has a C-shaped cross section; a flat connection sheet portion 182 which is located frontward (downward in FIGS. 3 and 5) of the crimp portion 181; fixing tab portions 183 located rearward of the crimp portion 181; and fixing tab portions 184 located at respective opposite ends of the connection sheet portion 182. The crimp portion 181 is crimp-deformed, thereby internally holding the conductor 176 of the sensor connection line 175. As mentioned previously, the connection sheet portion 182 of the connection member 180 and the terminal portion 143LT of the electrode lead portion 143L of the first electrode sheet 143 are welded together. The fixing tab portions 183 and 184 are engaged with a lead-fixing bore 151FH formed in a lead-fixing tubular member 151, which will be described later, thereby fixing the connection member 180 to the lead-fixing tubular member 151.

Figure 4:
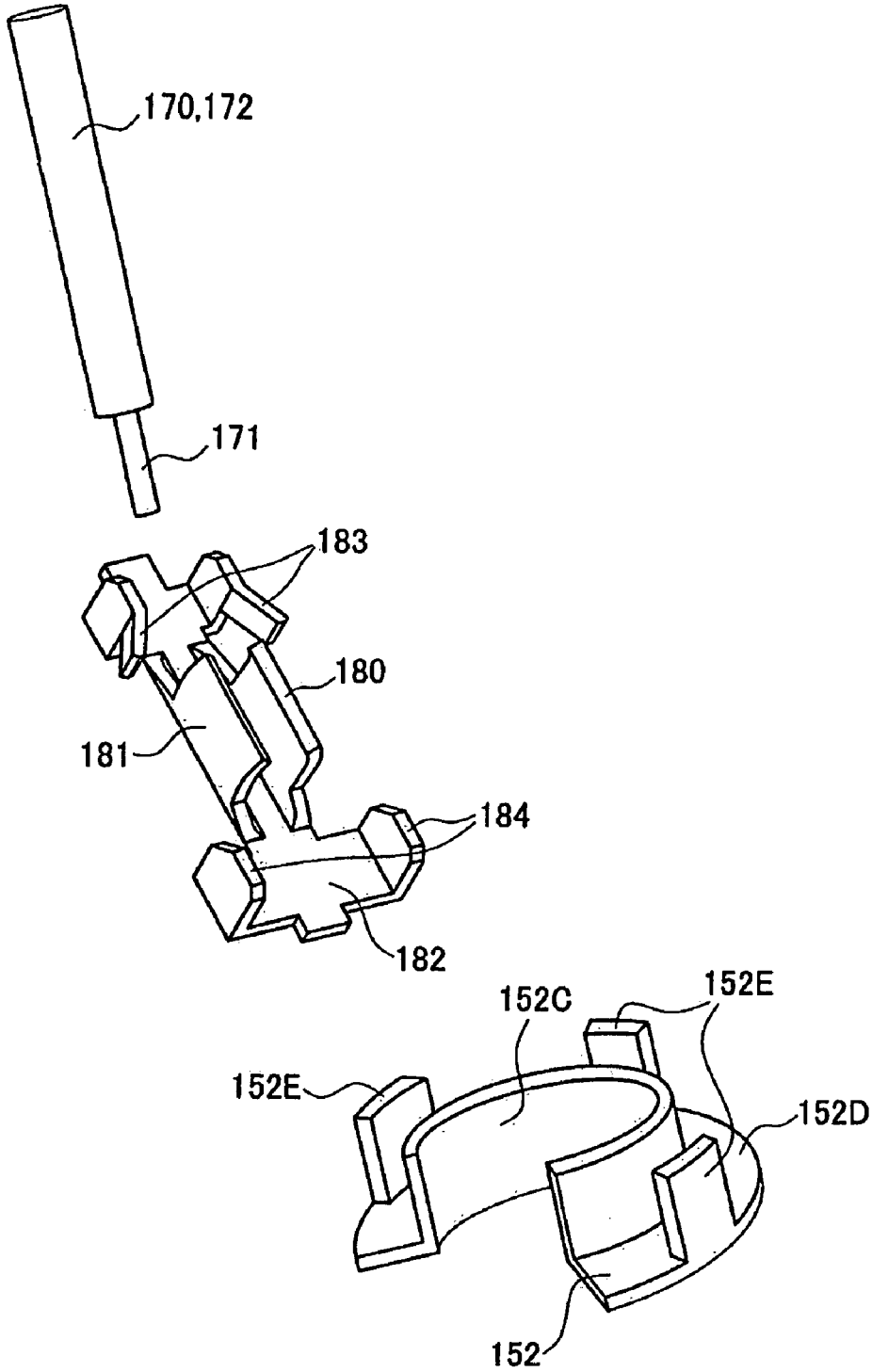
FIG. 4 is an explanatory view for explaining how a heater power lead wire and a connection terminal are connected and how the connection terminal and a junction member are connected.

As shown in FIG. 4, each of the three heater power lead wires 170 is also composed of a conductor 171 and a coating layer 172, which is formed from an insulating resin and covers the conductor 171. The heater power lead wires 170 are also fixed to the respective connection terminals 180 by crimping, which connection terminals 180 have the same shape as that of the connection terminal 180 used with the sensor connection line 175.

The crimp portion 181 of the connection terminal 180 is crimp-deformed, thereby internally holding the conductor 171 of each of the heater power lead wires 170. The fixing tab portions 183 and 184 are engaged with the lead-fixing bore 151FH formed in the lead-fixing tubular member 151, thereby fixing each of the connection members 180 to the lead-fixing tubular member 151.

As shown in FIG. 4, the connection sheet portions 182 of the connection members 180 to be connected to the respective heater power lead wires 170 are connected to a junction member 152. Specifically, the junction member 152 is formed from an iron-nickel alloy. As shown in FIG. 3, the junction member 152 is disposed on the rear side (upper side in FIG. 3) of the inward projecting portion 148N of the sensor cap 148 via an annular insulating sheet 150. As shown in FIG. 4, the junction member 152 has a tubular portion 152C which has a cutout and assumes the form of a substantially ⅔-cylinder; an arc portion 152D which extends radially outward from a front-end portion of the tubular portion 152C and assumes the form of a flat, substantially ⅔-ring; and three connection tongue portions 152E which stand rearward from a circumferential edge portion of the arc portion 152D and are circumferentially spaced apart from one another.

The connection tongue portions 152E and the respective connection sheet portions 182 of the connection terminals 180 are connected together by welding. Although unillustrated in FIG. 4, the heater power lead wires 170 are connected to the three connection tongue portions 152E, respectively, via the connection terminals 180. As shown in FIG. 3, the tubular portion 152C of the junction member 152 is disposed in such a manner as to enclose the axial rod 130 and the rear tubular-portion 137 of the axial-rod sleeve 136 and is fixed by crimping to the rear tubular-portion 137. Thus, currents supplied from the three heater power lead wires 170 can be collected at the junction member 152, and the collected current can be applied to the heater conductor 121 of the heater member 120 via the axial-rod sleeve 136 and the axial rod 130.

In the present embodiment, the conductors 171 of the heater power lead wires 170 are connected to the junction member 152 via the connection terminals 180 to which the conductors 171 are connected by crimping. Accordingly, as opposed to the case where the conductors 171 of the heater power lead wires 170 are directly connected to the junction member 152 or the like by soldering or welding, there can be prevented occurrence of cracking or electrical disconnection which could otherwise result from vibration or the like, thereby enhancing the reliability of connection.

As mentioned previously, the sensor connection line 175, the three heater power lead wires 170, and the connection terminals 180 connected thereto are fixed within the respective lead-fixing bores 151FH of the lead-fixing tubular member 151. As shown in FIG. 3, the lead-fixing tubular member 151 has a cylindrical shape having a large center bore 151H which allows partial insertion of the axial rod 130 and the rear tubular-portion 137 of the axial-rod sleeve 136. The lead-fixing tubular member 151 is formed from an insulating resin. The lead-fixing tubular member 151 has four lead-fixing bores 151FH which are formed around the center bore 151H at circumferentially equal intervals. When the connection terminals 180 are inserted into the respective lead-fixing bores 151FH, the fixing tab portions 183 and 184 are engaged with the lead-fixing bores 151FH.

Furthermore, the grommet 190 of fluorine-containing rubber is disposed on the rear side (upper side in FIG. 3) of the lead-fixing tubular member 151. The grommet 190 has four insertion holes 190H through which the sensor connection line 175 and the three heater power lead wires 170 are respectively inserted. The grommet 190 is disposed in a rear end portion 160*k* of the sensor-portion-enclosing tube 160, thereby closing the sensor-portion-enclosing tube 160. Furthermore, the grommet 190 and the rear end portion 160*k* of the sensor-portion-enclosing tube 160 are crimped such that their diameters are reduced radially inward (left-right direction in FIG. 3). This brings an outer circumferential surface 190S of the grommet 190 into close contact with the rear end portion 160*k* of the sensor-portion-enclosing tube 160, thereby establishing liquid tightness therebetween. Furthermore, the crimping work establishes close contact and thus liquid tightness between the grommet 190 and the sensor connection line 175 in the insertion hole 190H, and close contact and thus liquid tightness between the grommet 190 and the three heater power lead wires 170 in the insertion holes 190H. That is, the grommet 190 liquid-tightly holds the heater power lead wires 170 and the sensor connection line 175.

In the glow plug 100 of the present embodiment, the sensor portion 140 has the piezoelectric elements 142 and 147. However, as mentioned above, since the grommet 190 liquid-tightly closes the rear end portion 160*k* of the sensor-portion-enclosing tube 160, entry of water, oil, or the like into the sensor portion 140 is prevented, thereby eliminating a potential deterioration in characteristics, such as insulating performance, of the piezoelectric elements 142 and 147. Thus, combustion pressure can be appropriately detected.

As mentioned previously, in the glow plug 100, the front-end portion 130*s* of the axial rod 130 is connected to the heater member 120 in a mechanically rigid manner. When, as a result of variation of the combustion pressure of an internal combustion engine, the heater member 120 moves axially rearward, the axial rod 130 also moves rearward. The sensor portion 140 is configured so as to detect variation of the combustion pressure by means of movement of the axial rod 130 (axial-rod sleeve 136) associated with movement of the heater member 120.

In a certain glow plug, an axial rod projects rearward from its rear end, and a rear end portion of the axial rod serves as a terminal for supplying power to the heater member 120. In the thus-configured glow plug, a lead wire for supplying power to a heater is connected to the projecting rear end portion of the axial rod. Thus, vibration of the lead wire or vibration of the axial rod induced by contact of the projecting rear end portion of the axial rod with another member is transmitted to a sensor portion, potentially resulting in superposition of noise on a combustion-pressure output from the sensor portion.

By contrast, in the glow plug 100 of the present embodiment, the axial rod 130 does not project rearward from the rear end of the glow plug 100. Specifically, the axial rod 130 is disposed frontward of the grommet 190. Accordingly, the axial rod 130 is not directly connected to a lead wire at a position located rearward of the glow plug 100. Therefore, the glow plug 100 is free from superposition of noise on output from the sensor portion 140 which could otherwise result from vibration of the lead wire or accidental vibration induced by contact of the axial rod with another member.

The three heater power lead wires 170 are used to supply power to the heater member 120. Even when the heater power lead wires 170 vibrate, since the heater power lead wires 170 are inserted through the grommet 190, the grommet 190 restrains vibration of the heater power lead wires 170. Thus, the vibration is unlikely to be transmitted to the axial rod 130 (axial-rod sleeve 136). Therefore, noise is unlikely to be superposed on output from the sensor portion 140.

Furthermore, in the glow plug 100 of the present embodiment, the sensor connection line 175 and the three heater power lead wires 170 have the same outside diameter, and thus the insertion holes 190H formed in the grommet 190 have the same diameter. Also, the insertion holes 190H are arranged around the axis AX at circumferentially equal intervals. Accordingly, by crimping the grommet 190 and the rear end portion 160*k* of the sensor-portion-enclosing tube 160 in such a manner as to reduce their diameters, in any insertion holes 190H, the grommet 190 and the sensor connection line 175 as well as the grommet 190 and the individual heater power lead wires 170 uniformly come into contact with each other, thereby enhancing liquid tightness therebetween.

In the glow plug 100 of the present embodiment, when the grommet 190 is in a holding condition (in a crimped condition), a minimum outside diameter D of a portion of the grommet 190 in liquid-tightly close contact with the sensor-portion-enclosing tube 160 is a relatively small value of 11.8 mm. Meanwhile, in order to apply a large current to the heater member 120 for quickly raising the temperature of the heater member 120, the conductors 171 of the three heater power lead wires 170 each have a diameter of 1.125 mm and a cross-sectional area of 0.99 $mm^2$. Also, the heater power lead wires 170 each have an outside diameter d of 2.1 mm. Accordingly, the total cross-sectional area of the three conductors 171 is 2.97 $mm^2$. By use of the three heater power lead wires 170, as mentioned previously, a current of up to 40 A can be appropriately applied at a low resistance. In this manner, in the glow plug 100 of the present embodiment, while each of the heater power lead wires 170 is small in the cross-sectional area of the conductor 171, a plurality of (three in the present embodiment) heater power lead wires 170 can collectively provide a sufficiently large total cross-sectional area of the conductors 171. That is, since a plurality of the heater power lead wires 170 are provided, current (power) to be applied to the heater member 120 can be divided into those which flow through the respective heater power lead wires 170, thereby reducing current (power) which flows through each of the heater power lead wires 170. Thus, each of the heater power lead wires 170 can be reduced in the cross-sectional area of its conductor 171 and in the outside diameter d as measured to include its coating layer 172.

Since the glow plug 100 of the present embodiment uses three heater power lead wires 170, in comparison with the case of using a single heater power lead wire having a relatively large diameter, each of the insertion holes 190H formed in the grommet 190 can be reduced in diameter. Accordingly, liquid tightness can be maintained between the grommet 190 and the inserted heater power lead wires 170, and the minimum outside diameter D of the grommet 190 can be maintained at a small value. Therefore, the glow plug 100 can be protected against entry of liquid such as water or oil into the interior thereof between the sensor-portion-enclosing tube 160 and the grommet 190 or between the grommet 190 and the heater power lead wires 170 or between the grommet 190 and the sensor connection line 175.

Furthermore, since the heater power lead wires 170 and the sensor connection line 175 are coated with the coating layers 172 and 177, respectively, of an insulating resin, even when water or the like splashes on a rear end portion of the glow plug 100, no electrical communication is established between the sensor-portion-enclosing tube 160, the heater power lead wires 170, and the sensor connection line 175.

As mentioned previously, the diameter of the sensor-portion-enclosing tube 160 is smaller than the opposite-side distance of the tool engagement portion 112 of the housing 110. That is, the sensor-portion-enclosing tube 160 has such a size as to be encompassed within the engagement-portion-projected region PA which is indicated by the broken line in FIG. 3. Accordingly, in the glow plug 100, the outline of the sensor-portion-enclosing tube 160 imposes limitations on the arrangement of the heater power lead wires 170 and the sensor connection line 175 and on the outline of the grommet 190. Also, as mentioned above, the shape of the sensor-portion-enclosing tube 160 is limited to a shape which is encompassed within the engagement-portion-projected region PA. Therefore, the minimum outside diameter D of the grommet 190 must be reduced, and the heater power lead wires 170 and the sensor connection line 175 must be compactly arranged.

Also, in this connection, the glow plug 100 employs a plurality of (three in the present embodiment) heater power lead wires 170. Therefore, although the minimum outside diameter D of the grommet 190 assumes a small value, the heater power lead wires 170 and the sensor connection line 175 can appropriately extend rearward through the grommet 190.

The outside diameter d of the heater power lead wire 170 is limited to 20% or less; specifically, 18% (=2.1/11.8), of the minimum outside diameter D of the grommet 190 in a holding condition. Accordingly, in the present embodiment, while a large current can be applied to the heater conductor 121 through the three heater power lead wires 170, the grommet 190 can maintain appropriate liquid tightness and can be reduced in its outside diameter D.

Next, the manufacture of the glow plug 100 of the present embodiment will be described. Description of a method of manufacturing those sections of the glow plug 100 other than the plug rear-end section 101 and the sensor-containing section 102 is omitted, since those sections can be manufactured by a known method.

The manufacture of the plug rear-end section 101 and the sensor-containing section 102 will next be described. The second piezoelectric element 147, the ring portion 146R of the second electrode sheet 146, and the second insulating spacer 145 are placed in this order on the rear end face of the housing rear-end portion 113 of the housing 110. Furthermore, the axial rod 130 is inserted into the axial-rod sleeve 136 to which the insulating tubes 195 and 196 are fitted. The front tubular-portion 139 of the axial-rod sleeve 136 is inserted through the second piezoelectric element 147, the second electrode sheet 146, and the second insulating spacer 145. Then, the first insulating spacer 144, the ring portion 143R of the first electrode sheet 143, the first piezoelectric element 142, and the pressing spacer 141 are fitted in this order to the rear tubular-portion 137 of the axial-rod sleeve 136 so as to rest on the rear side of the outward projecting portion 138 of the axial-rod sleeve 136.

Furthermore, the above-assembled members are covered with the sensor cap 148. While the sensor cap 148 is pressed frontward along the axis AX, the sensor cap 148 is welded to the housing rear-end portion 113 at the weld zone 149. As a result, the sensor portion 140 is held in such a condition that a compressive stress is applied thereto along the axis AX. The axial-rod sleeve 136 and the rear end portion 130*k* of the axial rod 130 are welded together at the weld zone 137W. Thus, the outward projecting portion 138 of the axial-rod sleeve 136 moves according to movement of the axial rod 130. The electrode lead portions 143L and 146L of the first and second electrode sheets 143 and 146, respectively, are bent rearward. The rear end portion 146LT of the electrode lead portion 146L of the second electrode sheet 146 is overlaid on and welded to the electrode lead portion 143L of the first electrode sheet 143.

Furthermore, the annular insulating sheet 150 and the junction member 152 are placed on the rear side of the inward projecting portion 148N of the sensor cap 148. The tubular portion 152C of the junction member 152 is crimped so as to be fixed to the rear tubular-portion 137 of the axial-rod sleeve 136, whereby electrical communication is established therebetween. Furthermore, an insulating spacer 153 of an insulating resin is placed so as to cover the arc portion 152D of the junction member 152 and the insulating sheet 150.

Next, the connection terminals 180 are crimp-connected (see FIGS. 4 and 5) to respective distal end portions of the heater power lead wires 170 and the sensor connection line 175, which are inserted through the respective insertion holes 190H of the grommet 190, through the sensor-portion-enclosing tube 160, and through the respective lead-fixing bores 151FH of the lead-fixing tubular member 151. Furthermore, the connection sheet portions 182 of the connection terminals 180 connected to the heater power lead wires 170, and the respective connection tongue portions 152E of the junction member 152 are welded together. The connection sheet portion 182 of the connection terminal 180 connected to the sensor connection line 175, and the terminal portion 143LT of the electrode lead portion 143L of the first electrode sheet 143 are welded together.

The lead-fixing tubular member 151 is placed on the rear side of the insulating spacer 153. Distal end portions of the heater power lead wires 170 and the sensor connection line 175 and the connection terminals 180 connected to the distal end portions are drawn into the respective lead-fixing bores 151FH of the lead-fixing tubular member 151. The sensor-portion-enclosing tube 160 is disposed in such a manner as to enclose the insulating spacer 153 and the sensor portion 140 from the radially outside and such that its front-end portion encloses the housing rear-end portion 113. The sensor-portion-enclosing tube 160 and the housing rear-end portion 113 are welded together at the weld zone 161.

Then, the grommet 190 is disposed in the rear end portion 160*k* of the sensor-portion-enclosing tube 160, thereby closing the rear end portion 160*k*. Furthermore, the rear end portion 160*k* is crimped so as to reduce its diameter, thereby disposing the grommet 190 in the rear end portion 160*k* of the sensor-portion-enclosing tube 160 in a liquid-tight condition.

The glow plug 100 according to the present embodiment is thus completed.

Embodiment 2

A glow plug having a built-in combustion pressure sensor 200 according to Embodiment 2 will next be described with reference to FIGS. 6 to 10. Embodiment 1 described above uses the piezoelectric elements 142 and 147 to detect combustion pressure. The glow plug 200 according to Embodiment 2 differs from Embodiment 1 in that a piezoresistive element is used to detect combustion pressure. Therefore, different features will be mainly described, and description of similar features will be omitted or be brief.

Figure 6:
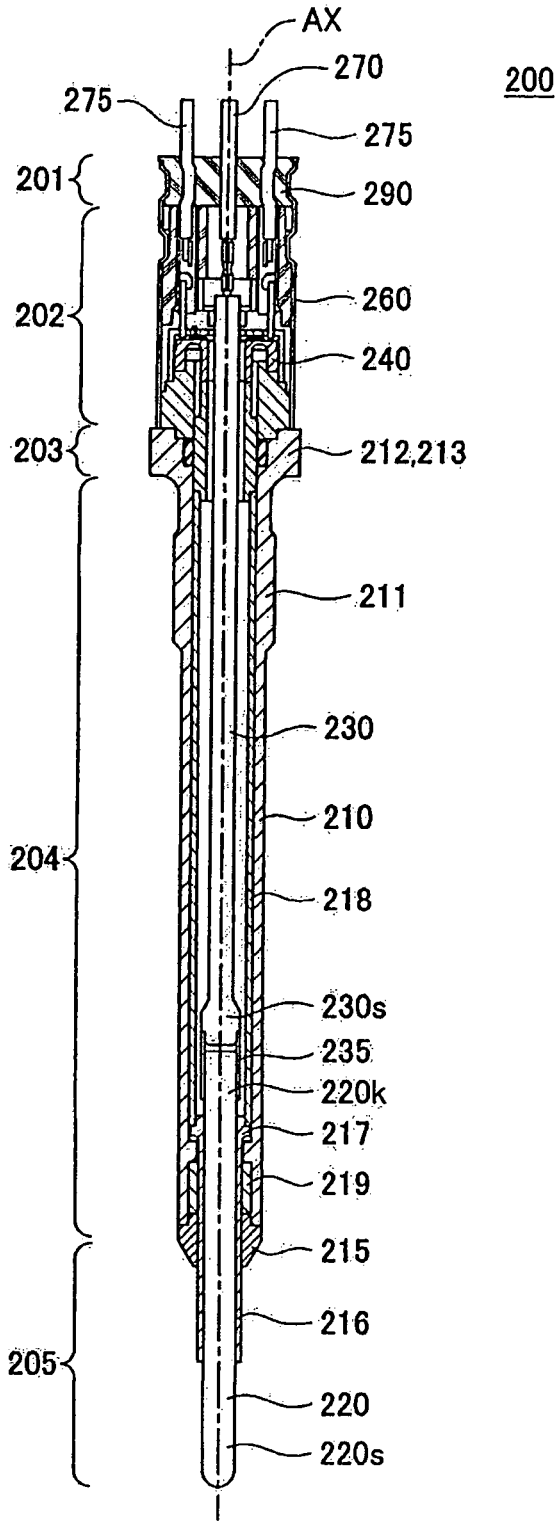
FIG. 6 is a vertical sectional view showing the structure of a glow plug having a built-in combustion pressure sensor using a piezoresistive element according to Embodiment 2 of the present invention.

FIG. 6 shows an external view and the structure of the glow plug 200 according to Embodiment 2. The glow plug 200 also can generate heat at a heater member 220 through energization for assisting the start of an internal combustion engine and has a sensor portion 240 configured so as to detect variation of combustion pressure of the internal combustion engine.

The glow plug 200 also assumes a shaft-like form extending along the axis AX and includes, from the rear side (upper side in FIG. 6) to the front side (lower side in FIG. 6) along the axis AX, a plug rear-end section 201, a sensor-containing section 202, a hexagonal section 203, a plug intermediate-trunk section 204, and a plug front-end section 205.

The plug rear-end section 201 is located most rearward in the glow plug 200 and encompasses a grommet 290, which will be described later. Two heater power lead wires 270 and three sensor connection lines 275 extend rearward from the plug rear-end section 201 (grommet 290). The sensor-containing section 202 contains a sensor portion 240, which includes a piezoresistive element 242 for detecting the combustion pressure of an internal combustion engine (not shown) to which the glow plug 200 is attached. The hexagonal section 203 assumes the form of a hexagonal prism and has a tool engagement portion 212 of a housing 210. The plug front-end section 205 is composed primarily of the heater member 220, which will be described later. The plug intermediate-trunk section 204 is located between the hexagonal section 203 and the plug front-end section 205 and assumes a generally cylindrical form. The plug intermediate-trunk section 204 includes an externally threaded portion 211 having external threads.

Figure 7:
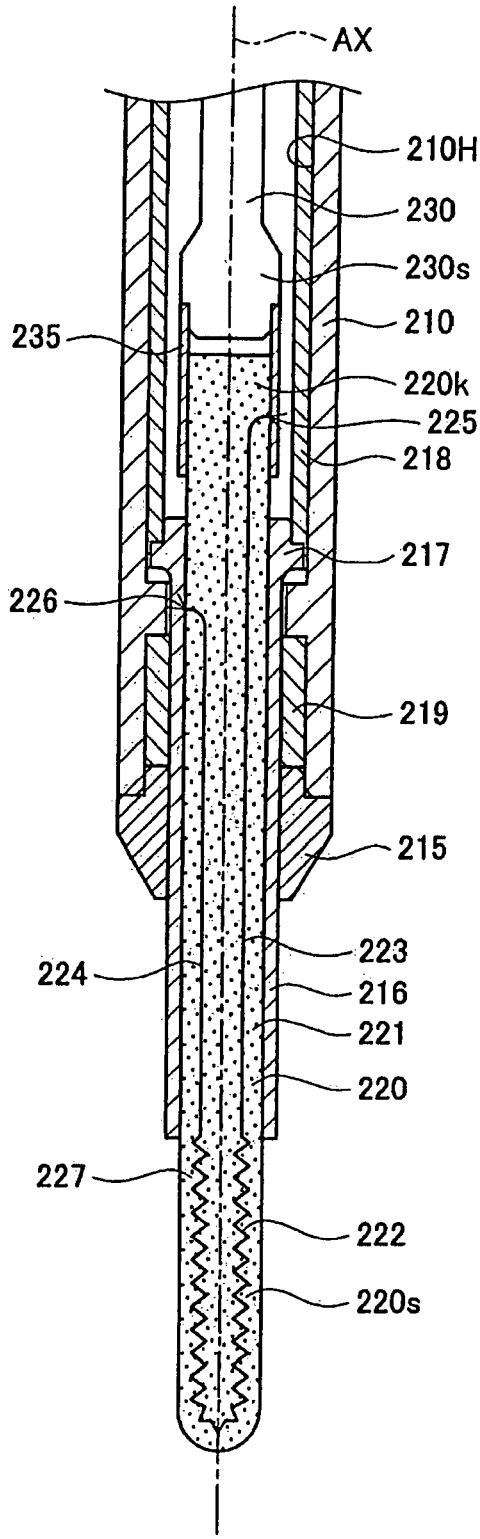
FIG. 7 is a partial, vertical sectional view showing the structure of a front-end portion of the glow plug having a built-in combustion pressure sensor according to Embodiment 2.

As shown in FIGS. 6 and 7, the glow plug 200 has the tubular housing 210 which extends along the axis AX (axial direction). The glow plug 200 further has an axial rod 230 which is held within the housing 210 and is electrically conductive, and the rod-like heater member 220 which is disposed frontward (downward in FIGS. 6 and 7) of the axial rod 230 and is electrically connected to the axial rod 230 by means of a connection ring 235. The heater member 220 is press-fitted into and held by a heater-holding member 216 at a front-end portion of the housing 210.

Figure 8:
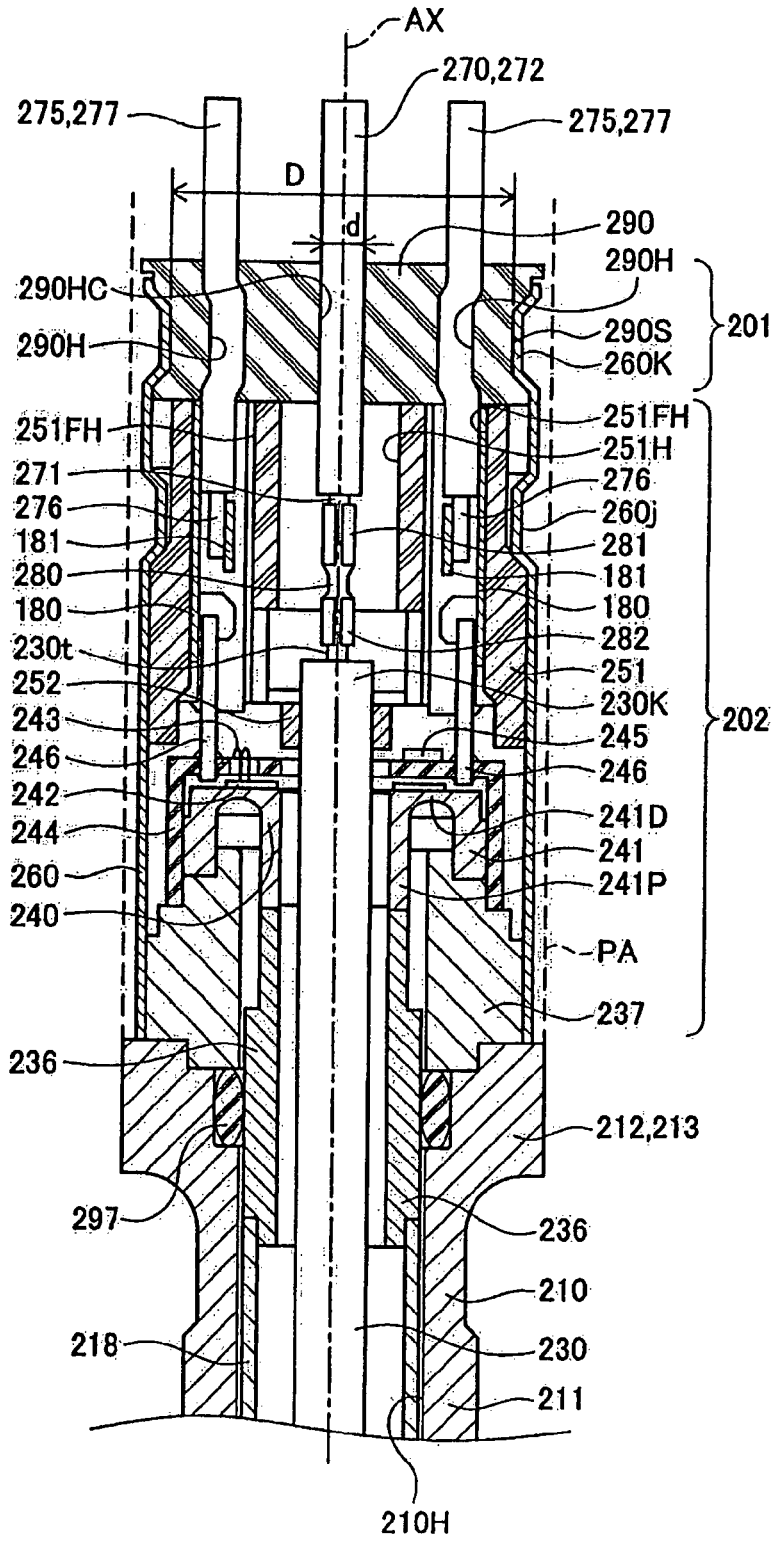
FIG. 8 is a partial, vertical sectional view showing the structure of a rear end portion of the glow plug having a built-in combustion pressure sensor according to Embodiment 2.
Figure 9:
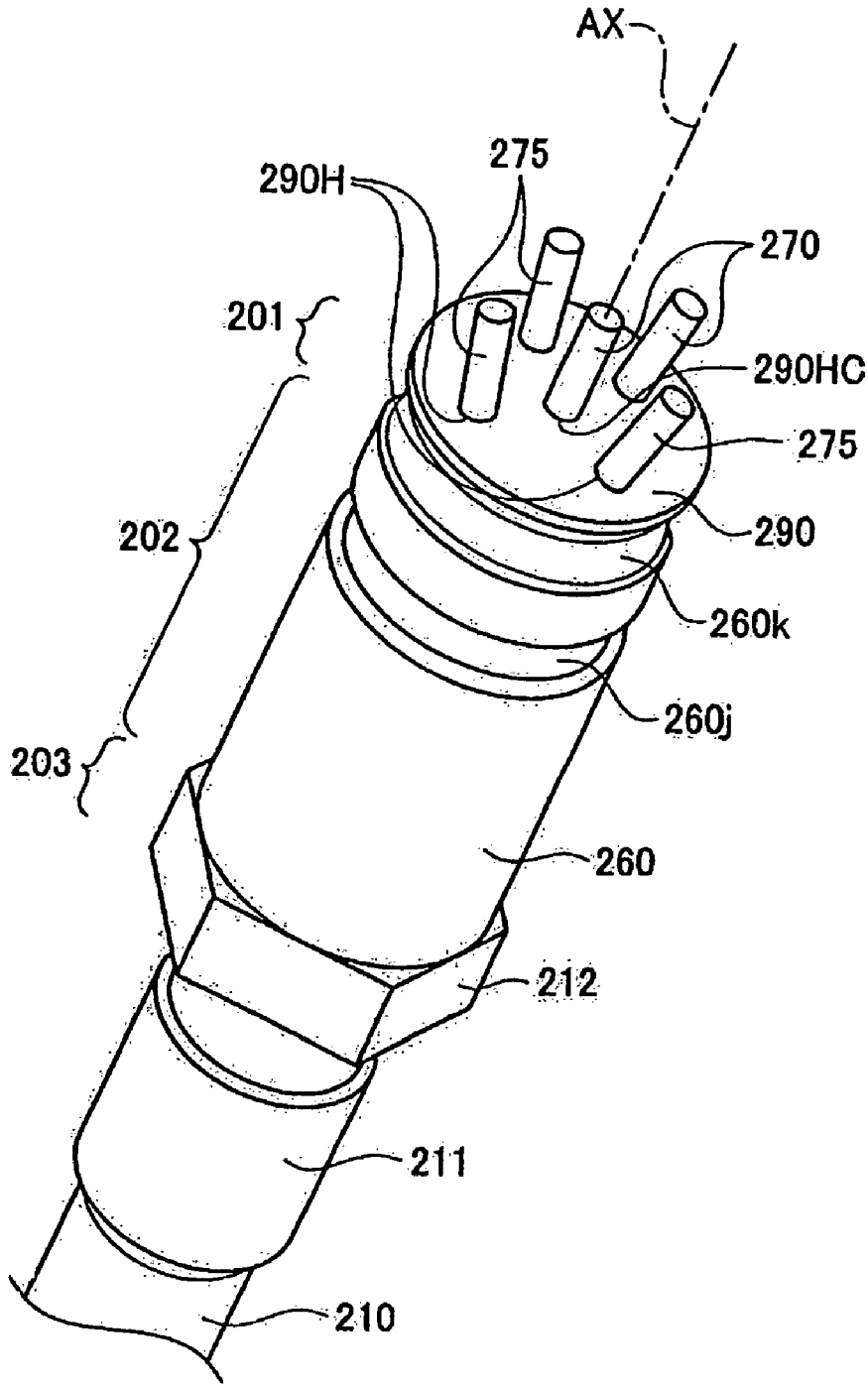
FIG. 9 is an enlarged, partial, perspective view showing a rear end portion of the glow plug having a built-in combustion pressure sensor according to Embodiment 2.

As shown in FIGS. 6 and 8, the glow plug 200 has the sensor portion 240 which is contained within the sensor-containing section 202 located at its rear side and which can detect combustion pressure. The glow plug 200 further include the three sensor connection lines 275 for transmitting power to drive circuits of the sensor portion 240 and transmitting an output from the sensor portion 240 to an external device; the two heater power lead wires 270 electrically connected to the axial rod 230; and a sensor-portion-enclosing tube 260 for enclosing the sensor portion 240, etc.

In the glow plug 200, as shown in FIG. 7, the heater member 220 located in the front-end section 205 assumes a columnar form whose front end has a generally semispherical shape. The heater member 220 has a structure similar to that of the heater member 120 of Embodiment 1. Specifically, the heater member 220 includes an insulating ceramic body 227 and a heater conductor 221, which is embedded in the insulating ceramic body 227. The heater member 220 is disposed such that its front-end portion 220*s* projects frontward from the heater-holding member 216. The heater conductor 221 is formed into a shape resembling the letter U and has a heater heat-generating portion 222 which has high resistance and generates heat upon energization, and heater lead portions 223 and 224 which extend rearward from the heater heat-generating portion 222. The heater heat-generating portion 222 is disposed within the front-end portion 220*s*.

End portions of the heater lead portions 223 and 224 are exposed at the outer circumferential surface of a rear end portion of the heater member 220 and serve as an axial-rod-side conductor end portion 225 and a ground-side conductor end portion 226, respectively. The axial-rod-side conductor end portion 225 is formed at a rear end portion 220*k* of the heater member 220 and is electrically connected to the axial rod 230 in a mechanically rigid manner by means of the tubular connection ring 235 which is press-fitted to the rear end portion 220*k* and welded to a front-end portion 230*s* of the axial rod 230.

The ground-side conductor end portion 226 electrically communicates with the heater-holding member 216. Accordingly, the ground-side conductor end portion 226 can be grounded through a holding member 219, which will next be described, and the housing 210. Thus, current can flow from the axial rod 230 to the heater conductor 221. Therefore, the heater heat-generating portion 222 and thus, the front-end portion 220*s* of the heater member 220, can generate heat.

The glow plug 200 using the heater member 220 is also a so-called quick-temperature-rise-type glow plug.

The heater-holding member 216 is held in such a manner as to be movable along the axis AX, by the holding member 219 which is formed from graphite and self-lubricating. Accordingly, when the glow plug 200 is attached to an internal combustion engine (not shown) and is subjected to variation of combustion pressure, the heater-holding member 216 and the heater member 220 press-fitted into the heater-holding member 216 move along the axis AX according to the variation of combustion pressure. As mentioned above, the axial rod 230 and the rear end portion 220*k* of the heater member 220 are connected together via the connection ring 235 in a mechanically rigid manner. Thus, when the heater member 220 moves, the axial rod 230 also moves accordingly.

A rear end portion of the heater-holding member 216 is formed into a rear-end large-diameter portion 217 which is greater in diameter than the remaining portion of the heater-holding member 216. A cylindrical slide pipe 218 into which the axial rod 230 is loosely inserted is welded to the rear-end large-diameter portion 217. Accordingly, when combustion pressure varies, the slide pipe 218 also moves along the axis AX together with the heater-holding member 216.

A front-end-closing member 215 whose outline assumes the form of a truncated cone and which also functions as a stopper to prevent detachment of the holding member 219 is disposed frontward of the housing 210 and the holding member 219 and fixedly attached to the housing 210.

Next, a rear-end region of the glow plug 200 will be described. As shown in FIGS. 6 and 8, the housing 210 has the tool engagement portion 212 having a shape of a hexagonal prism. The tool engagement portion 212 is located most rearward in the housing 210 and also serves as a housing rear-end portion 213. The cylindrical sensor-portion-enclosing tube 260 is disposed rearward (upward in FIGS. 6 and 8) of the housing rear-end portion 213.

As in the case of the glow plug 100 of Embodiment 1, the diameter of the sensor-portion-enclosing tube 260 is also smaller than the opposite-side distance of the tool engagement portion 212 of the housing 210. Accordingly, the sensor-portion-enclosing tube 260 is encompassed within an engagement-portion-projected region PA which is indicated by the broken line in FIG. 8 and which results from rearward projection of the tool engagement portion 212 along the axis AX. Thus, when the glow plug 200 is to be attached to or detached from an internal combustion engine (not shown), the above feature allows a tool such as a wrench to be engaged with the tool engagement portion 212 by fitting the tool to the tool engagement portion 212 from an axially rearward direction of the glow plug 200 in such a manner as to enclose the sensor-containing section 202 and the hexagonal section 203. Then, the glow plug 200 can be rotated with the tool.

The axial rod 230 is formed from iron and is disposed in such a manner as to extend rearward of the housing 210. However, the axial rod 230 is disposed frontward of the grommet 290, which will be described later. The slide pipe 218 is disposed axially movably in an axial-rod insertion bore 210H of the housing 210 and is engaged with a push pipe 236. As a result, the push pipe 236 also moves along the axis AX according to variation of combustion pressure.

An O-ring 297 is disposed between the push pipe 236 and the housing rear-end portion 213 (tool engagement portion 212) of the housing 210. The O-ring 297 prevents entry of high-pressure gas coming from the front side into the sensor portion 240, thereby preventing corrosion and hindrance to detection of combustion pressure which could otherwise result from the entry of the high-pressure gas.

A holder member 237 for holding a diaphragm member 241 is disposed rearward (upward in FIG. 8) of the housing rear-end portion 213.

The diaphragm member 241 has a diaphragm portion 241D which is thin-walled so as to be readily deformable. When the push pipe 236 pushes a pressure-receiving end portion 241P of the diaphragm member 241, the diaphragm portion 241D is deformed.

Figure 10:
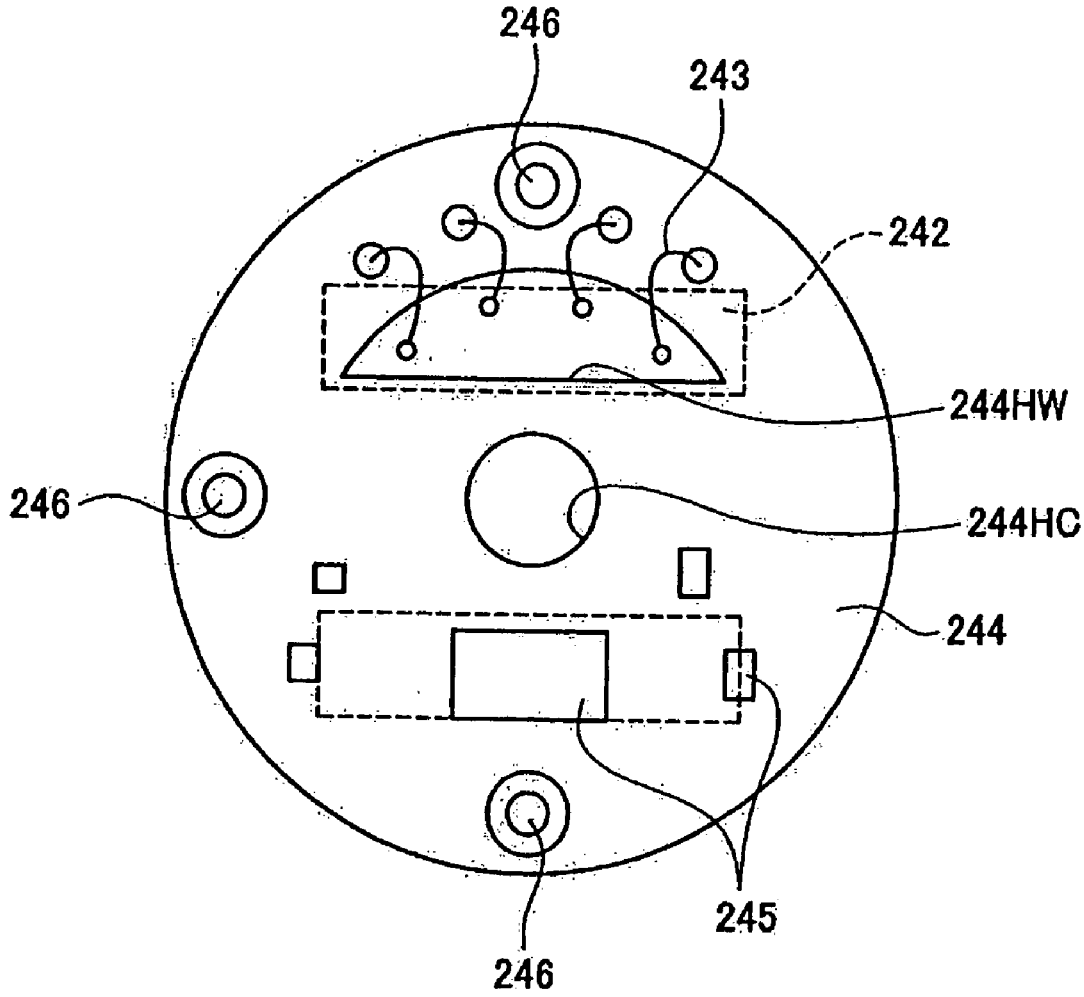
FIG. 10 is an explanatory view for explaining the appearance of a printed circuit board for use in the glow plug having a built-in combustion pressure sensor according to Embodiment 2.

A piezoresistive element 242 is affixed to the rear side of the diaphragm portion 241D. As the diaphragm member 241D is deformed, the resistance of the piezoresistive element 242 varies accordingly. As shown in FIG. 10, a printed circuit board 244 has an axial-rod insertion hole 244HC through which the axial rod 230 is inserted, and a wire insertion hole 244HW. The resistance of the piezoresistive element 242 is detected, via bonding wires 243, by a detection circuit (not shown) composed of circuit elements 245 and the like on the printed circuit board 244. On the basis of the detected resistance, a sensor output signal is generated. The sensor output signal is output from one of three connection pins 246 which stand on the printed circuit board 244. The remaining two connection pins 246 are used to receive power for driving the detection circuit from the sensor connection lines 275.

As in the case of the electrode lead portion 143L of the first electrode sheet 143 (see FIG. 5) in Embodiment 1 described previously, the three connection pins 246 are welded to the respective connection sheet portions 182 of the connection terminals 180. As in the case of Embodiment 1, these connection terminals 180 are connected to the respective sensor connection lines 275. Specifically, each of the sensor connection lines 275 is configured such that a conductor 276 is coated with a coating layer 277. The conductor 276 is crimp-held by the crimp portion 181 of the connection terminal 180, whereby the conductor 276 and the connection terminal 180 are connected together.

Furthermore, as in the case of Embodiment 1, the fixing tab portions 183 and 184 are engaged with a lead-fixing bore 251FH formed in a lead-fixing tubular member 251, thereby fixing each of the connection members 180 and the sensor connection lines 275 to the lead-fixing tubular member 251.

A rearward projecting portion 230*t* having a small diameter projects rearward from a rear end portion 230*k* of the axial rod 230. The rearward projecting portion 230*t* and a conductor 271 of a single heater power lead wire 270 extending on the axis AX are connected together via a connection terminal 280. Specifically, the connection terminal 280 and the conductor 271 of the heater power lead wire 270 are connected together by means of crimping a first crimp portion 281. The rearward projecting portion 230*t* and the connection terminal 280 are connected together by means of crimping a second crimp portion 282.

The connection terminal 280 and the heater power lead wire 270 connected to the connection terminal 280 are disposed in a center bore 251H which is formed at a central portion of the lead-fixing tubular member 251.

Furthermore, a junction member 252 is fixedly crimped to the rear end portion 230*k* of the axial rod 230 so as to grip the rear end portion 230*k*. Although unillustrated in detail, the junction member 252 has a portion which extends toward a far side of the paper on which FIG. 8 appears, and is bent rearward to thereby assume a shape similar to that of the connection tongue portion 152E of the junction member 152 in Embodiment 1. As in the case of Embodiment 1 (see FIG. 4), this connection tongue portion of the junction member 252 is welded to the connection sheet portion of the connection terminal 280. This connection terminal 280 is crimp-connected to the other heater power lead wire 270. The connection terminal 280 and the heater power lead wire 270 are also fixedly engaged with the corresponding lead-fixing bore 251FH formed in the lead-fixing tubular member 251.

Thus, in the glow plug 200 of Embodiment 2, currents supplied from the two heater power lead wires 270 can be collected at the axial rod 230, and the collected current can be applied to the heater conductor 221 of the heater member 220.

Also, in Embodiment 2, the conductors 271 of the heater power lead wires 270 are connected to the junction member 252 and the rearward projecting portion 230*t* of the axial rod 230 via the connection terminals 180 and 280, respectively, to which the conductors 271 are connected by crimping. Accordingly, as opposed to the case where the conductors 271 of the heater power lead wires 270 are directly connected to the junction member 252 and the rearward projecting portion 230*t* by soldering or welding, there can be prevented occurrence of cracking or electrical disconnection which could otherwise result from vibration or the like, thereby enhancing the reliability of connection.

Furthermore, the grommet 290 of fluorine-containing rubber is disposed on the rear side (upper side in FIG. 8) of the lead-fixing tubular member 251. The grommet 290 has five insertion holes 290H and 290HC through which the three sensor connection lines 275 and the two heater power lead wires 270 are respectively inserted. Specifically, as is apparent from FIG. 9, the grommet 290 has the center insertion hole 290HC which extends through the grommet 290 along the axis AX and which allows insertion of the heater power lead wire 270 therethrough. Also, the grommet 290 has the four insertion holes 290H which are arranged around the center insertion hole 290HC at circumferentially equal intervals and which allow insertion of the three sensor connection lines 275 and one heater power lead wire 270 therethrough. The grommet 290 is disposed in a rear end portion 260*k* of the sensor-portion-enclosing tube 260, thereby closing the sensor-portion-enclosing tube 260. Furthermore, the grommet 290 and the rear end portion 260*k* of the sensor-portion-enclosing tube 260 are crimped such that their diameters are reduced radially inward (left-right direction in FIG. 8). This brings an outer circumferential surface 290S of the grommet 290 into close contact with the rear end portion 260*k* of the sensor-portion-enclosing tube 260, thereby establishing liquid tightness therebetween. Furthermore, the crimping work establishes close contact and thus liquid tightness between the grommet 290 and the sensor connection lines 275 in the insertion holes 290H, and close contact and thus liquid tightness between the grommet 290 and the heater power lead wires 270 in the insertion holes 290H and 290HC. That is, the grommet 290 liquid-tightly holds the heater power lead wires 270 and the sensor connection lines 275.

By virtue of the above configuration, also, in the glow plug 200 of Embodiment 2, entry of water, oil, or the like into the sensor portion 140 which has the piezoresistive element 242 and the circuit elements 245 is prevented, thereby eliminating a potential deterioration in characteristics, such as insulating performance, of the piezoresistive element 242 and the circuit elements 245. Thus, combustion pressure can be appropriately detected.

In the glow plug 200, as mentioned above, the front-end portion 230*s* of the axial rod 230 is connected to the heater member 220 in a mechanically rigid manner.

However, in the glow plug 200, the axial rod 230 does not project rearward from the rear end of the glow plug 200. Specifically, the axial rod 230 is disposed frontward of the grommet 290. Accordingly, the axial rod 230 is not directly connected to a lead wire or does not come into contact with another member at a position located rearward of the glow plug 200. Thus, the glow plug 200 is free from transmission of vibration to the axial rod 230 which could otherwise result from vibration of the lead wire or vibration induced by contact of the axial rod 230 with another member. Accordingly, the glow plug 200 is free from transmission of vibration from the axial rod 230 to the diaphragm portion 241D and the piezoresistive element 242 via the heater member 220, the slide pipe 218, and the push pipe 236.

The two heater power lead wires 270 are used to supply power to the heater member 220. Even when the heater power lead wires 270 vibrate, the grommet 290 through which the heater power lead wires 270 are inserted restrains vibration of the heater power lead wires 270. Thus, the vibration is unlikely to be transmitted to the axial rod 230. Therefore, noise is unlikely to be superposed on output from the sensor portion 240 (piezoresistive element 242).

In the glow plug 200 of Embodiment 2, the three sensor connection lines 275 and the two heater power lead wires 270 have the same outside diameter, and thus the four insertion holes 290H and the center insertion hole 290HC formed in the grommet 290 have the same diameter. Also, the four insertion holes 290H are arranged around the axis AX at circumferentially equal intervals. Accordingly, by crimping the grommet 290 and the rear end portion 260*k* of the sensor-portion-enclosing tube 260 in such a manner as to reduce their diameters, in any insertion holes 290H and 290HC, the grommet 290 and the individual sensor connection lines 275 as well as the grommet 290 and the individual heater power lead wires 270 uniformly come into contact with each other, thereby enhancing liquid tightness therebetween.

Notably, the diameter of the center insertion hole 290HC can be greater than that of the insertion holes 290H so that the heater power lead wire 270 inserted through the center insertion hole 290HC can have a greater outside diameter. Even in this case, since pressure is uniformly applied to the insertion holes 290H and 290HC, high liquid tightness can be maintained.

Since the glow plug 200 of Embodiment 2 also employs a plurality of the heater power lead wires 270, current (power) to be applied to the heater member 220 can be divided into those which flow through the respective heater power lead wires 270, thereby reducing current (power) which flows through each of the heater power lead wires 270. Thus, each of the heater power lead wires 270 can be reduced in the cross-sectional area of its conductor 271 and in outside diameter d as measured to include its coating layer 272. Accordingly, when the grommet 290 is in a holding condition (in a crimped condition), although a minimum outside diameter D of a portion of the grommet 290 in liquid-tightly close contact with the sensor-portion-enclosing tube 260 assumes a relatively small value, the sensor connection lines 275 and the heater power lead wires 270 can appropriately extend rearward through the grommet 290 in a liquid-tightly inserted and held condition.

Next, the manufacture of the glow plug 200 of the present embodiment will be described.

First, the manufacture of a front-end portion of the glow plug 200 will be described. The heater member 220 is press-fitted into the heater-holding member 216. The connection ring 235 is press-fitted to the rear end portion 220*k* of the heater member 220, and the connection ring 235 is welded to the front-end portion 230*s* of the axial rod 230. The slide pipe 218 is welded to the rear-end large-diameter portion 217 of the heater-holding member 216. The resultant subassembly is inserted into the housing 210 which has the holding member 219 at its predetermined front-end portion. The front-end-closing member 215 is fitted to the heater member 220 from the front side so as to abut the front end of the housing 210. The housing 210 and the front-end-closing member 215 are welded together.

Then, the manufacture of a rear end portion of the glow plug 200 will be described.

The push pipe 236 is disposed in the axial-rod insertion bore 210H of the housing 210 into which the axial rod 230 is inserted, and is engaged with the slide pipe 218. The O-ring 297 is disposed between the housing 210 and the push pipe 236, thereby preventing combustion gas from reaching the sensor portion 240 through the axial-rod insertion bore 210H.

The holder member 237 is fixed on the rear end of the housing rear-end portion 213 of the housing 210. The diaphragm member 241 is fixedly disposed on the rear end of the holder member 237. As a result, the pressure-receiving end portion 241P of the diaphragm member 241 abuts the push pipe 236. The printed circuit board 244 is disposed in such a manner as to cover the diaphragm member 241. The printed circuit board 244 and the piezoresistive element 242 are connected between their predetermined portions by means of bonding wires 243.

Next, the connection terminals 180 and 280 are crimp-connected (see FIGS. 6, 8, and 9) to respective distal end portions of the heater power lead wires 270 and the sensor connection lines 275, which are inserted through the respective insertion holes 290H and the center insertion hole 290HC of the grommet 290, through the sensor-portion-enclosing tube 260, and through the respective lead-fixing bores 251FH and the center bore 251H of the lead-fixing tubular member 251. Furthermore, the connection sheet portions 182 of the connection terminals 180 connected to the sensor connection lines 275, and the respective connection pins 246 are welded together. The connection sheet portion 182 of the connection terminal 180 connected to the heater power lead wire 270, and the connection tongue portion of the junction member 252 are welded together. The second crimp portion 282 of the connection terminal 280 connected to the other heater power lead wire 270, and the rearward projecting portion 230*t* of the axial rod 230 are connected together by crimping.

The lead-fixing tubular member 251 is placed on the rear side of the printed circuit board 244. Distal end portions of the heater power lead wire 270 and the sensor connection lines 275 and the connection terminals 180 connected to the distal end portions are drawn into the respective lead-fixing bores 251FH of the lead-fixing tubular member 251. The sensor-portion-enclosing tube 260 is disposed in such a manner as to enclose the printed circuit board 244 and the lead-fixing tubular member 251 from the radially outside and such that its front-end portion encloses the holder member 237. The holder member 237 and the sensor-portion-enclosing tube 260 are welded together.

An intermediate crimp portion 260j of the sensor-portion-enclosing tube 260 is crimped so as to reduce its diameter, thereby fixing the lead-fixing tubular member 251 within the sensor-portion-enclosing tube 260. Then, the grommet 290 is disposed in the rear end portion 260*k* of the sensor-portion-enclosing tube 260, thereby closing the rear end portion 260*k*. Furthermore, the rear end portion 260*k* is crimped so as to reduce its diameter, thereby disposing the grommet 290 in the rear end portion 260*k* of the sensor-portion-enclosing tube 260 in a liquid-tight condition.

The glow plug 200 according to the present embodiment is thus completed.

While the present invention has been described with reference to the above embodiments, the present invention is not limited thereto, but may be modified as appropriate without departing from the spirit or scope of the invention.

For example, the glow plugs 100 and 200 of Embodiments 1 and 2 are glow plugs having a built-in combustion pressure sensor for detecting combustion pressure. However, the present invention may be applied to a glow plug having a built-in sensor for detecting another item, such as heater temperature or combustion light.

What is claimed is:

1. A glow plug which includes a built-in sensor and which is adapted to be attached to an internal combustion engine, comprising:

a heater member having a heater conductor which generates heat upon energization, said heater member disposed at an axially front end of the glow plug along an axis of the glow plug;

a plurality of heater power lead wires each having a conductor and a coating layer which covers the conductor and is formed from an insulating resin, said heater power lead wires extending axially rearward, the conductors electrically communicating with one end of the heater conductor so as to supply power to the heater conductor;

a sensor portion which outputs predetermined information concerning the internal combustion engine or the glow plug;

at least a single sensor connection line covered with an insulating resin, connected directly or indirectly to the sensor portion, said sensor connection line extending axially rearward from the sensor portion;

an enclosing member circumferentially enclosing a rear end portion of the heater member, front-end portions of the heater power lead wires, at least a portion of the sensor portion, and a front-end portion of the sensor connection line; and a grommet disposed in a rear end portion of said enclosing member, said grommet being formed from an insulating, rubber-like elastic material and forming a liquid-tight seal with said enclosing member, said grommet having a plurality of insertion holes that extend axially therethrough, said heater power lead wires and said sensor connection line extending through said insertion holes, said grommet forming a fluid-tight seal around said heater power lead wires and the sensor connection line.

2. A glow plug according to claim 1, wherein the enclosing member has a tool engagement portion which assumes a predetermined outer shape for engagement with a tool, and a rear portion which is located rearward of the tool engagement portion and which includes the rear end portion, and the rear portion dimensioned to be disposed within an engagement-portion-projected region which results from rearward projection of the tool engagement portion along the axis.

3. A glow plug according to claim 1, wherein a total cross-sectional area of the conductors of the plurality of heater power lead wires is 1.0 $mm^2$ or greater, and an outside diameter of each of the heater power lead wires is 20% or less of a minimum outside diameter of a portion of the grommet in a condition of holding the heater power lead wires, which portion of the grommet is in liquid-tightly close contact with the enclosing member.

4. A glow plug according to claim 2, wherein a total cross-sectional area of the conductors of the plurality of heater power lead wires is 1.0 $mm^2$ or greater, and an outside diameter of each of the heater power lead wires is 20% or less of a minimum outside diameter of a portion of the grommet in a condition of holding the heater power lead wires, which portion of the grommet is in liquid-tightly close contact with the enclosing member.

5. A glow plug according to any one of claims 1 to 4, wherein the sensor portion is a combustion-pressure sensor portion for measuring a combustion pressure of the internal combustion engine by use of a piezoelectric element or a piezoresistive element.

6. A glow plug according to claim 5, further comprising:

an axial rod which is disposed frontward of the grommet within the enclosing member and extends along the axis (AX) and whose front-end portion is connected to the heater member in a mechanically rigid manner, wherein the combustion-pressure sensor portion is configured so as to detect variation of the combustion pressure by means of movement of the heater member.

* * * * *